US008459960B2

(12) United States Patent
Mason et al.

(10) Patent No.: US 8,459,960 B2
(45) Date of Patent: Jun. 11, 2013

(54) JET PUMP ASSEMBLY

(75) Inventors: R. Paul Mason, Dearborn, MI (US); Paul E. Fisher, Brighton, MI (US); Dan K. Pangburn, Canton, MI (US); Martin X. Ptacek, Ceske Budejovice (CZ); Kevin J. Martus, Howell, MI (US)

(73) Assignee: Robert Bosch GmbH, Stuttgart (DE)

( * ) Notice: Subject to any disclaimer, the term of this patent is extended or adjusted under 35 U.S.C. 154(b) by 501 days.

(21) Appl. No.: 12/700,038

(22) Filed: Feb. 4, 2010

(65) Prior Publication Data

US 2010/0202898 A1 Aug. 12, 2010

Related U.S. Application Data

(60) Provisional application No. 61/151,070, filed on Feb. 9, 2009.

(51) Int. Cl.
*F04B 23/04* (2006.01)

(52) U.S. Cl.
USPC ..... 417/79; 417/88; 417/190; 123/510; 137/565.22

(58) Field of Classification Search
USPC ..... 417/79, 76, 88, 89, 182, 190; 123/510, 123/514; 137/565.22
See application file for complete search history.

(56) References Cited

U.S. PATENT DOCUMENTS 632,481 A * 9/1899 Trix ..... 417/166
1,543,834 A * 6/1925 Ehrhart ..... 417/161
4,178,134 A 12/1979 Babish et al.
4,503,885 A 3/1985 Hall
4,810,170 A 3/1989 Ide
5,121,719 A 6/1992 Okazaki et al.
5,197,444 A 3/1993 Lang et al.
5,564,397 A 10/1996 Kleppner et al.
5,769,061 A 6/1998 Nagata et al.
5,927,315 A 7/1999 Kim
5,992,394 A 11/1999 Mukaidani et al.
6,116,273 A 9/2000 Tarr
6,283,142 B1 9/2001 Wheeler et al.
6,352,067 B1 3/2002 Genslak
6,368,169 B1 4/2002 Jaeger
6,371,153 B1 4/2002 Fischerkeller et al.
6,394,129 B1 5/2002 Feichtinger et al.
6,405,717 B1 6/2002 Beyer et al.

(Continued)

FOREIGN PATENT DOCUMENTS

EP 1302354 4/2003
EP 1302354 A1 * 4/2003

(Continued)

OTHER PUBLICATIONS

RD 502056, Feb. 2006.

*Primary Examiner* — Devon Kramer
*Assistant Examiner* — Thomas Fink
(74) *Attorney, Agent, or Firm* — Michael Best & Friedrich LLP

(57) ABSTRACT

A jet pump assembly includes a fuel supply conduit, a first jet pump integrally formed as a single piece with the fuel supply conduit and in fluid communication with the fuel supply conduit, a second jet pump integrally formed as a single piece with the fuel supply conduit and in fluid communication with the fuel supply conduit, and an inlet conduit integrally formed as a single piece with the second jet pump.

22 Claims, 9 Drawing Sheets

U.S. PATENT DOCUMENTS 6,415,771 B1 7/2002 Mihatsch et al.
6,457,945 B2 * 10/2002 Kleppner et al. ..... 417/84
6,502,558 B1 1/2003 Brunel
6,505,644 B2 1/2003 Coha et al.
6,520,161 B2 2/2003 Hazama
6,705,298 B2 3/2004 Ramamurthy et al.
6,729,309 B2 5/2004 Schueler
6,776,141 B2 8/2004 Hamada et al.
6,832,602 B2 12/2004 Tanimura
6,840,270 B2 1/2005 Yu
6,880,569 B2 4/2005 Kato
6,923,208 B2 8/2005 Okabe et al.
6,955,158 B2 10/2005 Rumpf
6,966,302 B2 11/2005 Maroney
6,981,490 B2 1/2006 Nagata et al.
7,007,679 B2 3/2006 Okabe et al.
7,040,344 B2 5/2006 Wynn, Jr.
7,069,914 B2 7/2006 Nagata
7,117,856 B2 10/2006 Honda et al.
7,159,574 B2 1/2007 Hayashi et al.
7,216,633 B2 5/2007 Attwood et al.
7,234,451 B2 6/2007 Betz, II et al.
7,267,108 B2 9/2007 Barylski et al.
7,284,540 B2 10/2007 Attwood et al.
7,303,378 B2 * 12/2007 Kleppner et al. ..... 417/87
7,316,222 B2 1/2008 Danjyo
7,370,640 B2 5/2008 Dickenscheid
7,387,112 B2 6/2008 Oohashi et al.
2001/0026760 A1 * 10/2001 Kleppner et al. ..... 417/84
2002/0083983 A1 * 7/2002 Coha et al. ..... 137/565.22
2003/0226548 A1 12/2003 Herzog et al.
2004/0219029 A1 * 11/2004 Kleppner et al. ..... 417/77
2006/0112937 A1 6/2006 Tittmann
2007/0020114 A1 1/2007 McFarland et al.
2007/0217922 A1 * 9/2007 Braun et al. ..... 417/198
2007/0266762 A1 11/2007 Rumpf
2007/0283935 A1 12/2007 Yuda et al.
2008/0095642 A1 4/2008 Schelhas
2008/0142097 A1 6/2008 Rumpf
2008/0149074 A1 6/2008 Voelker
2008/0178849 A1 7/2008 Crary
2008/0184971 A1 8/2008 Lubinski et al.
2008/0202470 A1 8/2008 Dickenscheid et al.
2008/0273992 A1 11/2008 Killion
2009/0290994 A1 * 11/2009 Kieninger et al. ..... 417/198
2009/0304527 A1 * 12/2009 Wattai et al. ..... 417/151
2010/0319793 A1 * 12/2010 Smid et al. ..... 137/565.22
2011/0174275 A1 * 7/2011 Lim et al. ..... 123/509

FOREIGN PATENT DOCUMENTS

JP 2005147037 6/2005
JP 2006316701 11/2006
KR 793998 1/2008

* cited by examiner

JET PUMP ASSEMBLY

RELATED APPLICATIONS

This application claims priority to U.S. Provisional Patent Application No. 61/151,070 filed on Feb. 9, 2009, the entire content of which is incorporated herein by reference.

FIELD OF THE INVENTION

The present invention relates to vehicle fuel systems, and more particularly to vehicle fuel systems including jet pump assemblies.

BACKGROUND OF THE INVENTION

The use of bifurcated fuel tanks, also commonly referred to as saddle tanks, in conjunction with fuel delivery systems having a single fuel pump is known. In such systems, a reservoir surrounds the fuel pump and is constantly filled to ensure that a steady supply of fuel is available to the pump at all times. Normally, fuel is drawn into the fuel pump from the bifurcated tank portion housing the fuel pump, but if the fuel level is low or vehicle maneuvering is such that the fuel pump inlet cannot draw fuel, the fuel pump instantly draws fuel from the reservoir. A jet pump is typically used to draw fuel from the opposing bifurcated portion of the tank through a crossover line and into the reservoir. Fuel typically overflows the reservoir and excess fuel fills the bifurcated tank portion housing the fuel pump. This ensures that fuel is available to the fuel pump regardless of the level of fuel in either of the bifurcated tank portions.

SUMMARY OF THE INVENTION

The present invention provides, in one aspect, a jet pump assembly including a fuel supply conduit, a first jet pump integrally formed as a single piece with the fuel supply conduit and in fluid communication with the fuel supply conduit, a second jet pump integrally formed as a single piece with the fuel supply conduit and in fluid communication with the fuel supply conduit, and an inlet conduit integrally formed as a single piece with the second jet pump.

The present invention provides, in another aspect, a fuel pump module including a fuel reservoir and a separate jet pump assembly positioned in the fuel reservoir. The jet pump assembly includes a fuel supply conduit, a first jet pump integrally formed as a single piece with the fuel supply conduit and in fluid communication with the fuel supply conduit, a second jet pump integrally formed as a single piece with the fuel supply conduit and in fluid communication with the fuel supply conduit, and an inlet conduit integrally formed as a single piece with the second jet pump.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
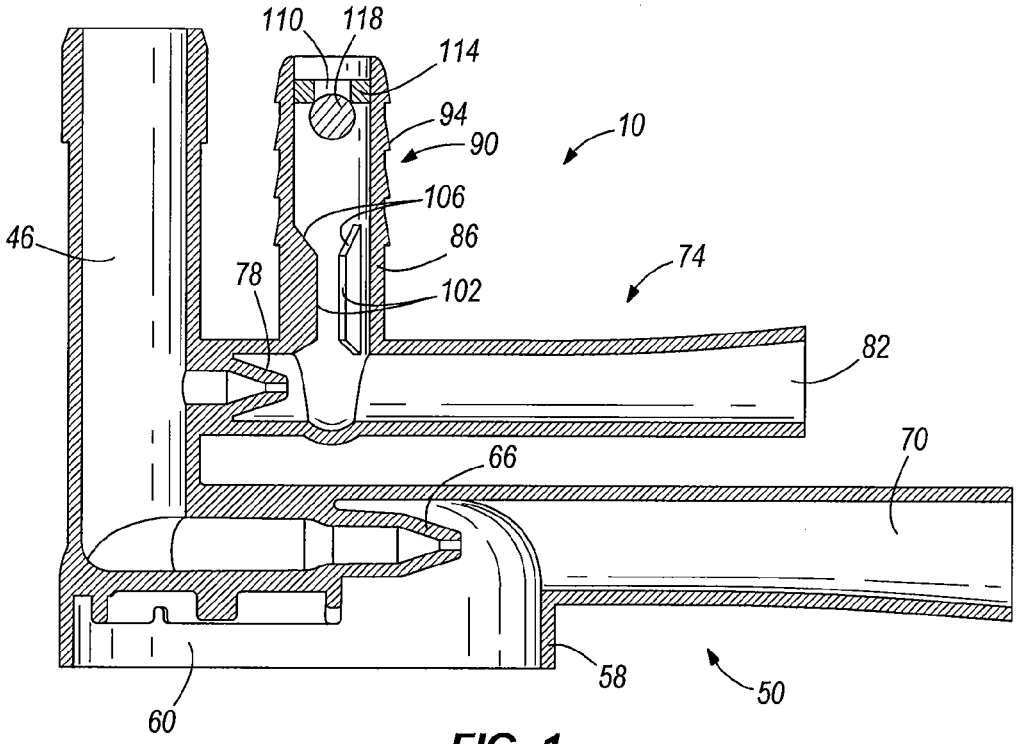
FIG. 1 is a cross-sectional view of a first construction of a jet pump assembly of the present invention, illustrating an anti-siphon valve of the jet pump assembly in a closed position.
Figure 2:
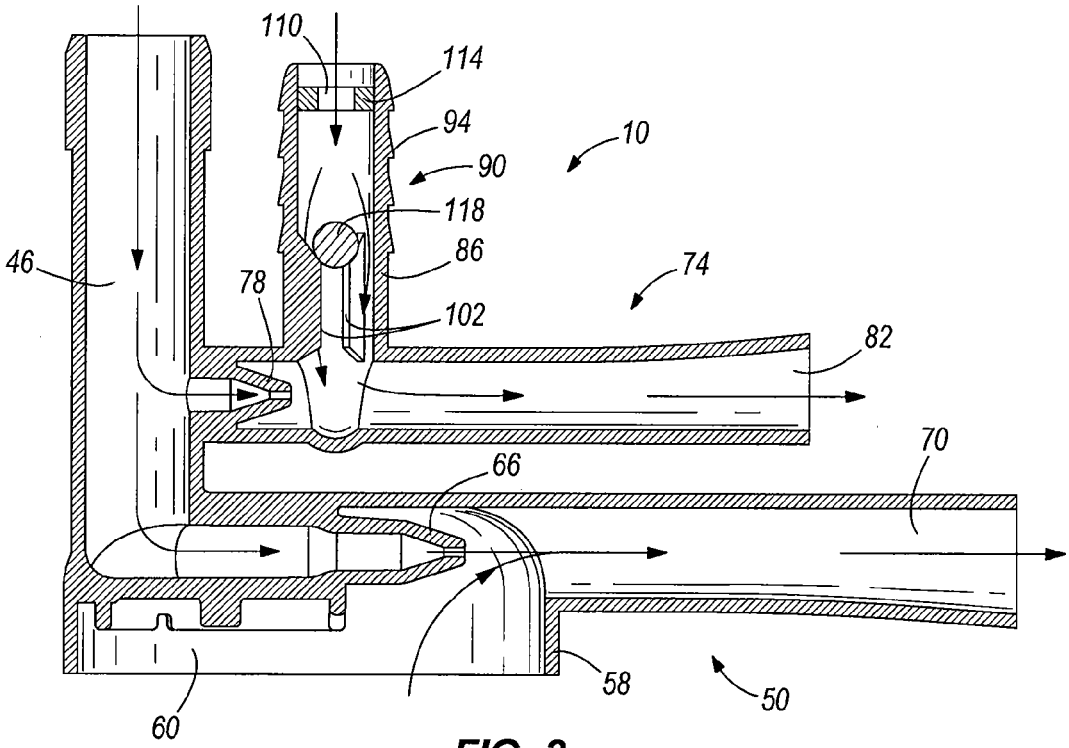
FIG. 2 is a cross-sectional view of the jet pump assembly of FIG. 1, illustrating the anti-siphon valve of the jet pump assembly in an open position.
Figure 3:
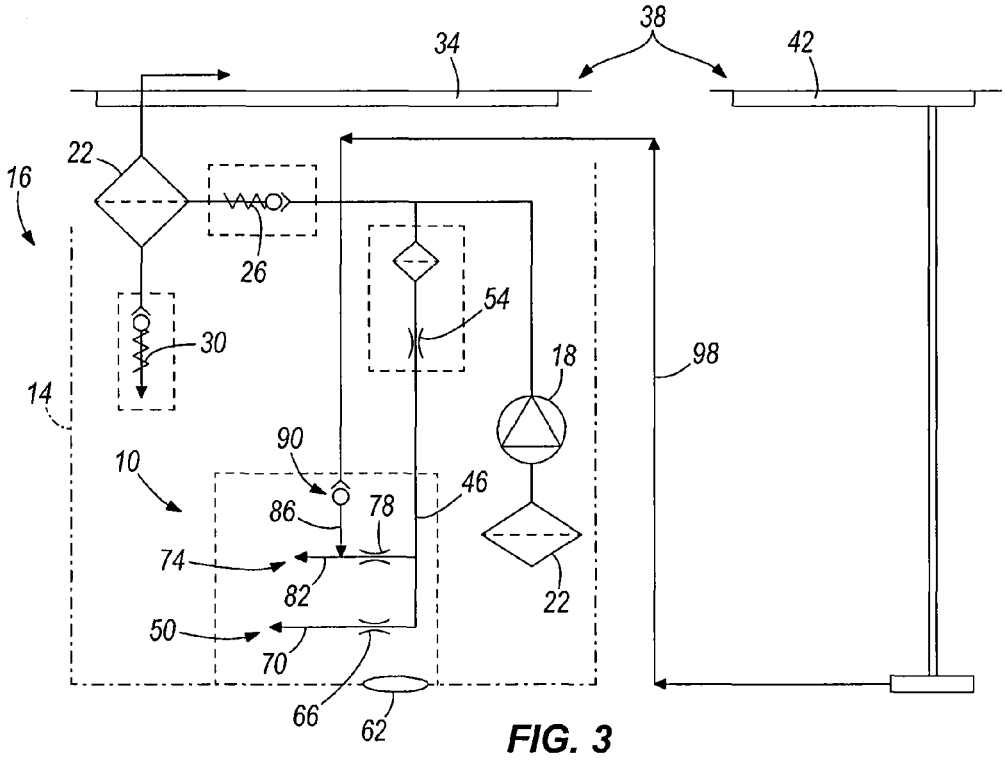
FIG. 3 is a schematic view of a first fuel system arrangement including the jet pump assembly of FIG. 1.

FIGS. 1-3 illustrate a first construction of a jet pump assembly 10 positionable in a reservoir 14 of a fuel pump module 16 for an internal combustion engine. In addition to the reservoir 14, other components of the fuel pump module 16 (e.g., a fuel pump 18, one or more filters 22, a check valve 26, and a fuel pressure regulator 30) are schematically illustrated in FIG. 3. The fuel pump module 16 is positioned on a primary side 34 of a bifurcated or saddle-style fuel tank 38. As described in more detail below, the jet pump assembly 10 draws fuel from both the primary side 34 of the fuel tank and a secondary side 42 of the fuel tank 38 into the reservoir 14 to fill the reservoir 14 and substantially immerse the fuel pump 18 with fuel. This allows the fuel pump 18 to access a substantially continuous supply of fuel regardless of the level of fuel in the primary side 34 or the secondary side 42 of the fuel tank 38. Such a saddle-style fuel tank 38 is described in more detail in U.S. Pat. No. 6,371,153, the entire content of which is incorporated herein by reference.

With reference to FIGS. 1 and 3, the jet pump assembly 10 includes a fuel supply conduit 46 and a first or primary jet pump 50 integrally formed as a single piece with the fuel supply conduit 46 and oriented substantially normal to the fuel supply conduit 46. The primary jet pump 50 is in fluid communication with the fuel supply conduit 46 to receive pressurized fuel from the fuel supply conduit 46 during operation of the fuel pump 18. With reference to FIG. 3, the fuel supply conduit 46 receives pressurized fuel directly from the output of the fuel pump 18 via a separate fuel supply conduit (not labeled). Specifically, the fuel pump module 16 also includes a throttle member 54 (e.g., an orifice) positioned upstream of the fuel supply conduit 46 to reduce the pressure of the pressurized fuel delivered to the fuel supply conduit 46. For example, the throttle member 54 may reduce the pressure of the pressurized fuel delivered to the fuel supply conduit 46 from about 5 bars to about 1 bar. Alternatively, the throttle member 54 may be configured to reduce the pressure of the pressurized fuel delivered to the fuel supply conduit 46 by a different amount.

Figure 4:
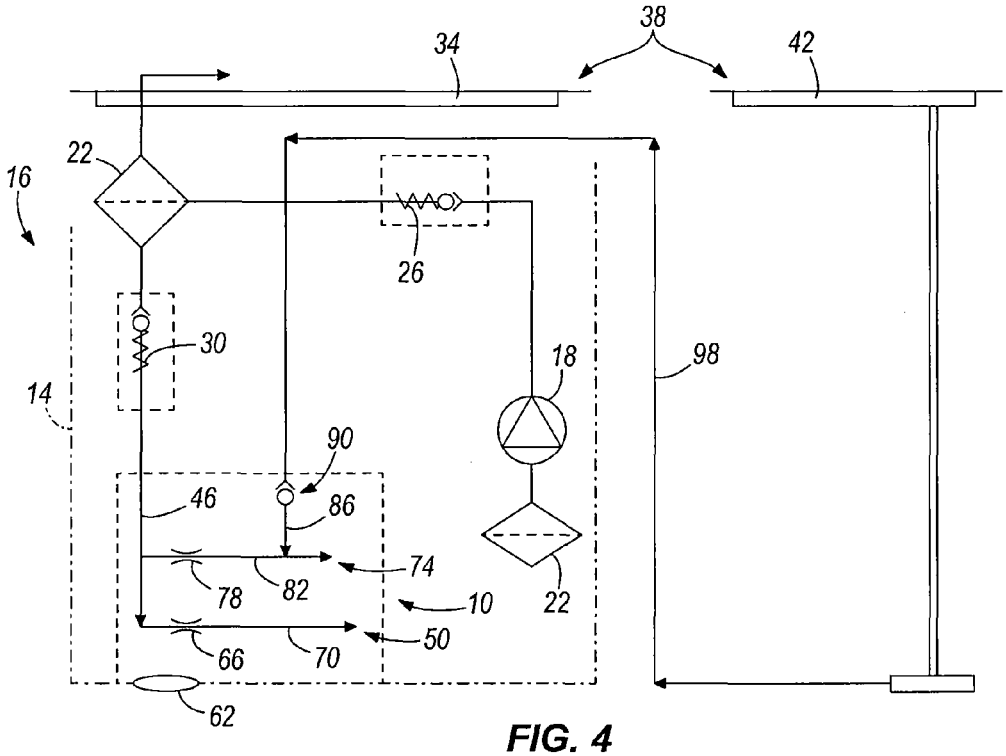
FIG. 4 is a schematic view of a second fuel system arrangement including the jet pump assembly of FIG. 1.

With reference to FIG. 4, the jet pump assembly 10 may be positioned within the fuel pump module such that the fuel supply conduit 46 receives "return" fuel from the fuel pressure regulator 30 to power the primary jet pump 50. The fuel pump 18 is sized to deliver fuel to the engine at a maximum flow rate and pressure. The fuel pressure regulator 30 provides a regulated supply of fuel to the engine that is often less than the maximum flow rate and pressure that the fuel pump 18 is capable of providing. The fuel pressure regulator 30, therefore, returns excess fuel that is not needed by the engine to the reservoir 14 to fill the reservoir 14. More particularly, the excess or return fuel from the fuel pressure regulator 30 is used to power the primary jet pump 50 before being returned to the reservoir 14.

With reference to FIG. 1, the jet pump assembly 10 also includes a base 58 integrally formed as a single piece with the fuel supply conduit 46 and the primary jet pump 50. The base 58 defines an internal chamber 60 having an opening adjacent the bottom of the base 58 through which fuel is drawn in response to fuel being discharged through the primary jet pump 50. The reservoir 14 includes a receptacle (not shown) sized to receive the base 58 therein. An interference fit between the receptacle and the base 58 of the jet pump assembly 10 may be employed to at least partially secure the jet pump assembly 10 to the reservoir 14. Alternatively, any of a number of different fasteners or processes may be employed to secure the jet pump assembly 10 to the reservoir 14 (e.g., using screws, quick-connect structures, welding, adhesives, etc.).

With reference to FIG. 3, a one-way valve 62 (e.g., an umbrella-style valve) is coupled to the bottom of the reservoir 14 and is positioned within the internal chamber 60 of the base 58. Such a valve 62 is described in more detail in U.S. Pat. No. 5,769,061, the entire content of which is incorporated herein by reference. As is discussed in more detail below, the discharge of fuel through the primary jet pump 50 creates a region of low pressure within the internal chamber 60, thereby opening the one-way valve 62 to allow fuel in the primary side 34 of the fuel tank 38 to be drawn into the chamber 60 and subsequently mixed with the fuel discharged through the primary jet pump 50. The mixed fuel is then discharged into the reservoir 14 to fill the reservoir 14. However, shortly after de-activation of the fuel pump 18, fuel stops flowing through the primary jet pump 50, allowing the pressure exerted on each side of the one-way valve 62 to equalize which, in turn, allows the valve 62 to close. When the valve 62 is closed, fuel in the reservoir 14 is prevented from back-flowing through the primary jet pump 50 and siphoning to the primary side 34 of the fuel tank 38.

With continued reference to FIG. 3, the primary jet pump 50 also includes a nozzle 66 positioned adjacent the internal chamber 60 of the base 58 and a mixing tube 70 positioned downstream of the nozzle 66 (see FIGS. 1 and 2). As described above, discharge of fuel through the nozzle 66 creates a region of low pressure within the internal chamber 60 to open the one-way valve 62 and draw fuel from the primary side 34 of the fuel tank 38 into the chamber 60, where the fuel is mixed with fuel discharged through the nozzle 66 in the mixing tube 70. The mixed fuel is then discharged from the mixing tube 70 into the reservoir 14.

With reference to FIGS. 1 and 3, the jet pump assembly 10 also includes a second or secondary jet pump 74 integrally formed as a single piece with the fuel supply conduit 46. The secondary jet pump 74 is in fluid communication with the fuel supply conduit 46 to receive pressurized fuel from the fuel supply conduit 46 during operation of the fuel pump 18. As shown in FIGS. 3 and 4, the primary and secondary jet pumps 50, 74 are fluidly connected to the fuel supply conduit 46 in a parallel arrangement, such that the pressure of the fuel delivered to each of the primary and secondary jet pumps 50, 74 is substantially similar. Alternatively, the throttle member 54 may be associated with only one of the primary and secondary jet pumps 50, 74 such that one of the jet pumps 50, 74 receives fuel at a higher pressure than the other. Further, an additional throttle member may be associated with one of the primary and secondary jet pumps 50, 74 such that one of the jet pumps 50, 74 receives fuel at a lower pressure than the other. The secondary jet pump 74 includes a nozzle 78 and a mixing tube 82 positioned downstream of the nozzle 78.

With reference to FIGS. 1 and 2, the jet pump assembly 10 further includes an inlet conduit 86 integrally formed as a single piece with the secondary jet pump 74 and an anti-siphon valve 90 incorporated in the inlet conduit 86. The inlet conduit 86 fluidly communicates the secondary jet pump 74 and the secondary side 42 of the bifurcated or saddle-style fuel tank 38 to allow the secondary jet pump 74 to draw fuel from the secondary side 42 of the fuel tank 38. The inlet conduit 86 includes a plurality of barbs 94 arranged about its outer peripheral surface that facilitate securing a rubber or plastic "crossover" tube 98 to the inlet conduit 86. Such a crossover tube 98 (shown schematically in FIGS. 3 and 4) extends from the inlet conduit 86, over the hump of the bifurcated or saddle-style fuel tank 38, and into the secondary side 42 of the fuel tank 38.

With reference to FIGS. 1 and 2, the anti-siphon valve 90 includes a plurality of ribs 102 extending radially inwardly into the inlet conduit 86. The ribs 102 are integrally formed as a single piece with the inlet conduit 86. Although only two ribs 102 are illustrated in FIGS. 1 and 2, at least three ribs 102 extend radially inwardly into the inlet conduit 86. In addition, the ribs 102 are arranged symmetrically (i.e., equi-angularly spaced from each other) about a central axis of the inlet conduit. Alternatively, the ribs 102 may be arranged asymmetrically about the central axis of the inlet conduit 86, the purpose of which is discussed below. Each of the ribs 102 includes an inclined surface 106 toward the top of each of the ribs 102, the purpose of which is also discussed below. Alternatively, each of the ribs 102 may include a rounded corner or a ninety-degree corner toward the top of each of the ribs 102.

With continued reference to FIGS. 1 and 2, the anti-siphon valve 90 also includes an orifice 110 defined in the inlet conduit 86. More particularly, the orifice 110 is defined within an annular insert 114 positioned in the inlet conduit 86. The insert 114 may be a separate and distinct component from the inlet conduit 86 that is secured to the inlet conduit 86 during manufacture of the jet pump assembly 10 (e.g., by using an interference fit, welding, adhesives, etc.). Alternatively, the insert 114 may be integrally formed as a single piece with the inlet conduit 86. The anti-siphon valve 90 further includes a ball 118 movable in the inlet conduit 86 between a first position, in which the ball 118 is seated against the top surfaces 106 of the ribs 102, and a second position, in which the ball 118 is positioned adjacent the orifice 110 to block the flow of fuel through the orifice 110. The ball 118 is buoyant in fuel, such that the ball 118 is floated to the second position to block fuel flow through the orifice 110 by stagnant fuel in the inlet conduit 86. Alternatively, the ball 118 may not be buoyant in fuel, and a brief reverse flow of fuel through the inlet conduit 86 in response to deactivation of the fuel pump 18 may displace the ball 118 from being supported by the ribs 102 (see FIG. 2) toward the insert 114. After the ball 118 is seated against the insert 114 to block the orifice 110 (see FIG. 1), the pressure of the stagnant fuel in the inlet conduit 86 may provide a sufficient force to maintain the ball 118 against the insert 114 to block the orifice 110. As a further alternative, the anti-siphon valve 90 may include a resilient member (e.g., a spring) to bias the ball 118 toward the insert 114 to block the orifice 110.

In operation of the fuel pump 18 and the jet pump assembly 10, some of the pressurized fuel output by the fuel pump 18 is diverted toward the jet pump assembly 10 to power the jet pump assembly 10 and fill the reservoir 14 with fuel (see FIG. 3). As discussed above, the pressure of the diverted fuel is reduced by the throttle member 54 prior to entering the fuel supply conduit 46. The pressurized fuel in the fuel supply conduit 46 then feeds both the primary and secondary jet pumps 50, 74. As the pressurized fuel is discharged through the nozzle 66 of the primary jet pump 50, a low-pressure region within the internal chamber 60 of the base 58 is created, thereby opening the one-way valve 62 to allow fuel from the primary side 34 of the fuel tank 38 to be drawn into the internal chamber 60. Fuel drawn into the internal chamber 60 of the base 58 is mixed with the fuel discharged through the nozzle 66 in the mixing tube 70 and discharged into the reservoir 14 to fill the reservoir 14 (see FIG. 2). While this occurs, pressurized fuel discharged through the nozzle 78 of the secondary jet pump 74 creates a low-pressure region within the inlet conduit 86, thereby opening the anti-siphon valve 90 to allow fuel from the secondary side 42 of the fuel tank 38 to be drawn into the inlet conduit 86 (via the crossover tube 98), where it is mixed with fuel discharged through the nozzle 78 in the mixing tube 82 and discharged into the reservoir 14 to fill the reservoir 14.

More particularly, with reference to FIG. 2, the anti-siphon valve 90 is opened when the ball 118 is moved away from the insert 114 and held against the top surfaces 106 of the ribs 102 by the low-pressure region created in the inlet conduit 86 and the fuel flow through the inlet conduit 86 in the direction indicated by the arrows in FIG. 2. Because the ribs 102 are spaced from each other about the central axis of the inlet conduit 86, fuel flow through the inlet conduit 86 may occur around the ball 118 and through the gaps between adjacent ribs 102. Such fuel flow around the ball 118 would also cause the ball 118 to be seated or held against the top surfaces 106 of the ribs 102 in the middle of the inlet conduit 86 (i.e., the center of the ball 118 would be aligned with the central axis of the inlet conduit 86). Alternatively, in a configuration of the jet pump assembly 10 in which the ribs 102 are asymmetrically positioned about the central axis of the inlet conduit 86 (i.e., when the spacing between adjacent ribs 102 is unequal), the fuel flow around the ball 118 may cause the ball 118 to wedge between adjacent ribs 102 at a location offset from the middle of the inlet conduit 86, such that the center of the ball 118 would be misaligned with the central axis of the inlet conduit 86. This asymmetrical arrangement of the ribs 102 may decrease the amount of flutter experienced by the ball 118 during operation of the jet pump assembly 10.

With reference to FIG. 4, operation of the jet pump assembly 10 is substantially similar as that described above with respect to FIG. 3, except the jet pump assembly 10 is powered by return fuel from the fuel pressure regulator 30 rather than receiving fuel directly from the output of the fuel pump 18. The return fuel provided by the fuel pressure regulator 30 has a reduced pressure compared to that of the fuel supplied to the engine, such that a throttle member (e.g., throttle member 54) is not required upstream of the fuel supply conduit 46.

Figure 5:
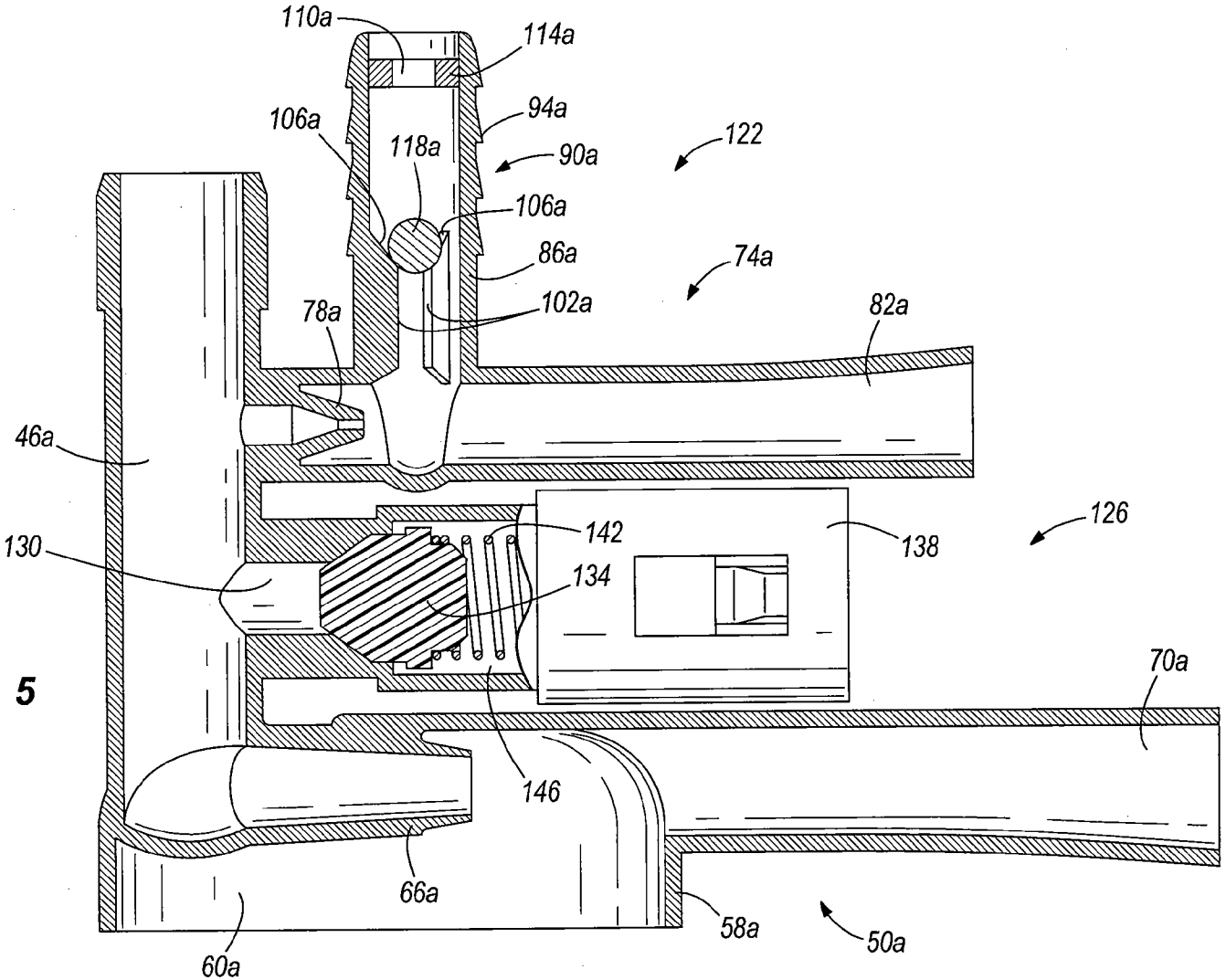
FIG. 5 is a partial cross-sectional view of a second construction of a jet pump assembly of the present invention, illustrating a pressure relief valve coupled to a fuel supply conduit of the jet pump assembly.
Figure 6:
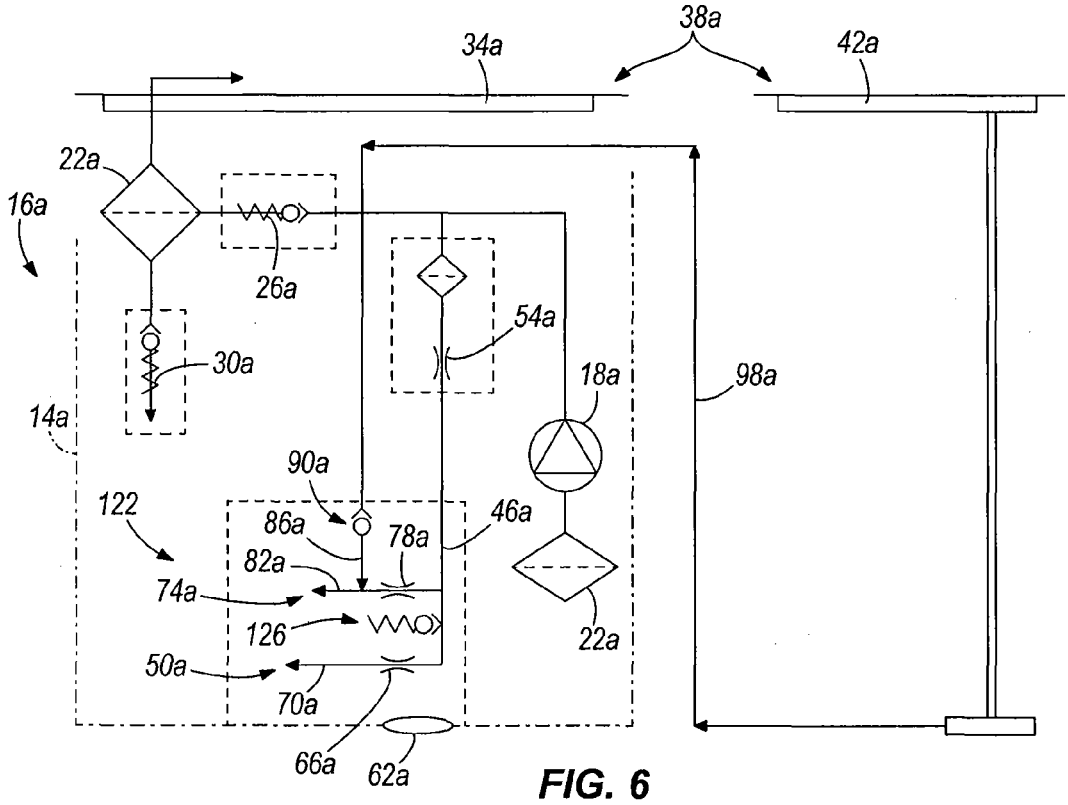
FIG. 6 is a schematic view of a first fuel system arrangement including the jet pump assembly of FIG. 5.
Figure 7:
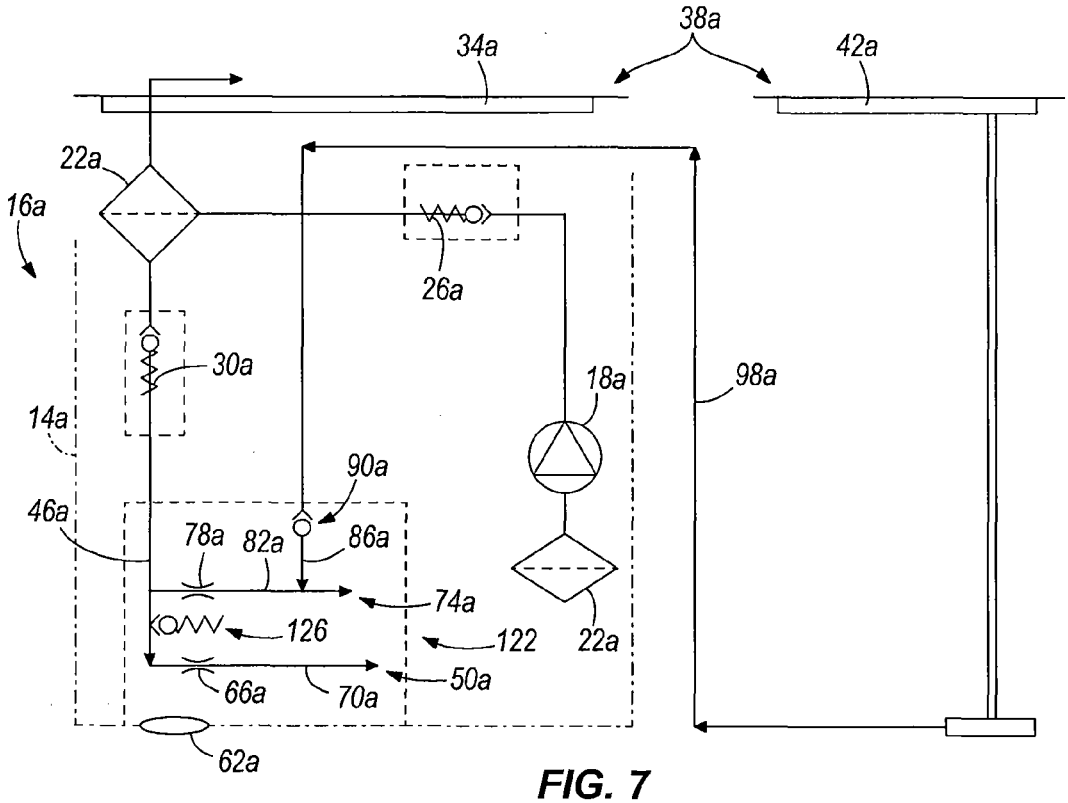
FIG. 7 is a schematic view of a second fuel system arrangement including the jet pump assembly of FIG. 5.

FIGS. 5-7 illustrate a second construction of a jet pump assembly 122 positionable in a reservoir **14*a* of a fuel pump module 16*a*, with like components having like reference numerals with the letter "a." The jet pump assembly 122 includes a pressure relief valve 126 in fluid communication with the fuel supply conduit 46*a* to selectively allow pressurized fuel in the fuel supply conduit 46*a* to be discharged directly into the reservoir 14*a* while bypassing the primary and secondary jet pumps 50*a*, 74*a*. The pressure relief valve 126 includes a bypass conduit 130 integrally formed as a single piece with the fuel supply conduit 46*a*, a seal member or poppet 134 movable between a first position adjacent an outlet of the bypass conduit 130 to block fuel flow through the outlet, and a second position spaced from the outlet, a retainer 138 coupled to the bypass conduit 130, and a resilient member (e.g., a compression spring 142) positioned between the poppet 134 and the retainer 138 to bias the poppet 134 toward the first position adjacent the outlet of the bypass conduit 130. The retainer 138 includes a plurality of apertures 146 through which fuel is discharged from the outlet of the bypass conduit 130 and into the reservoir 14. Alternatively, the retainer 138 may only include a single aperture 146 through which fuel is discharged from the outlet of the bypass conduit 130 and into the reservoir 14. The retainer 138 may be coupled to the bypass conduit 130 in any of a number of different ways (e.g., by using fasteners, quick-connect structures, welding, using adhesives, a threaded engagement, etc.). Alternatively, the retainer 138 may be integrally formed with the bypass conduit 130 as a single piece, and the poppet 134 and/or spring 142 may be subsequently positioned in their respective locations shown in FIG. 5**.

With reference to FIG. 6, the jet pump assembly 122 is operable in a similar manner as the jet pump assembly 10 in FIG. 3. Likewise, with reference to FIG. 7, the jet pump assembly 122 is operable in a similar manner as the jet pump assembly 10 in FIG. 4. However, should the pressure of the fuel upstream of the nozzles **66*a*, 78*a* in the respective primary and secondary jet pumps 50*a*, 74*a* suddenly increase beyond a predetermined amount, the pressurized fuel in the fuel supply conduit 46*a* may unseat the poppet 134 from the outlet of the bypass conduit 130, against the bias of the spring 142, to allow some of the pressurized fuel in the fuel supply conduit 46*a* to be discharged directly to the reservoir 14*a*, thereby bypassing the primary and secondary jet pumps 50*a*, 74*a*. When the pressure of the fuel in the fuel supply conduit 46*a* decreases below the predetermined amount, the spring 142 re-seats the poppet 134 against the outlet of the bypass conduit 130 to stop the discharge of fuel from the bypass conduit 130**.

Figure 8:
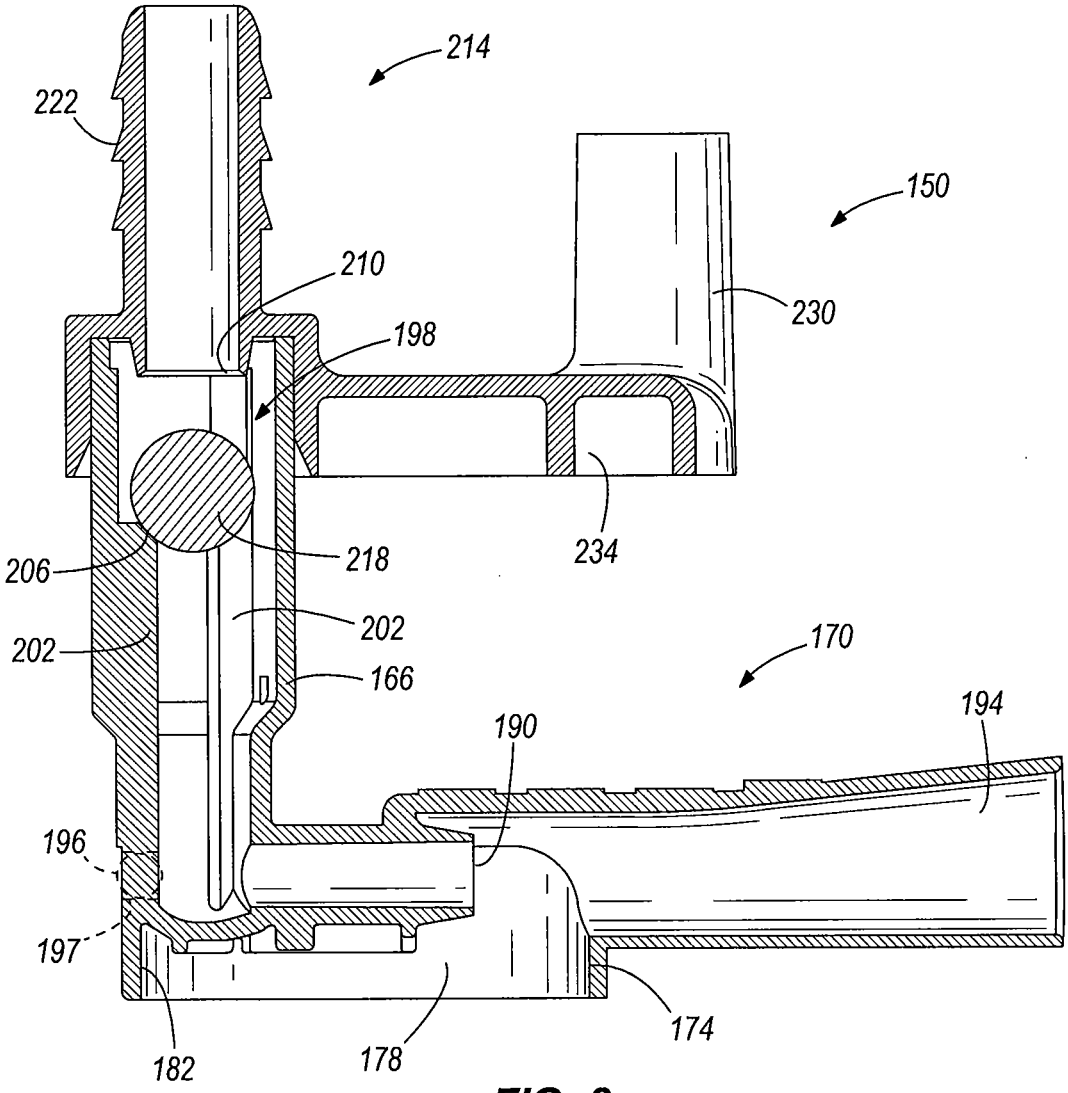
FIG. 8 is a cross-sectional view of a third construction of a jet pump assembly of the present invention, illustrating an anti-siphon valve of the jet pump assembly in an open position.
Figure 9:
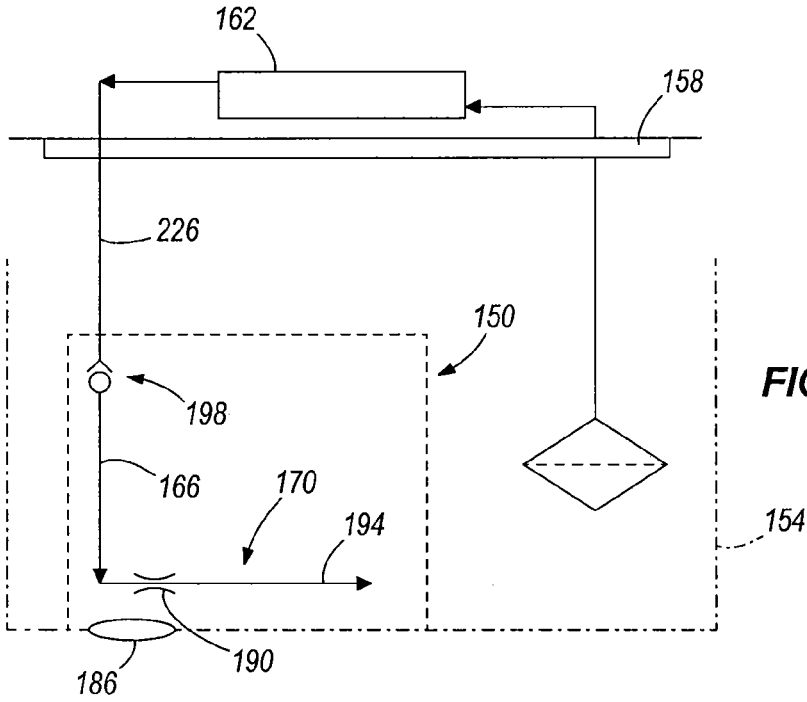
FIG. 9 is a schematic view of a fuel system arrangement including the jet pump assembly of FIG. 8.

FIG. 8 illustrates a third construction of a jet pump assembly 150 positionable in a reservoir 154 which, in turn, is positioned in a fuel tank 158 (schematically illustrated in FIG. 9). The fuel system arrangement shown in FIG. 9 is illustrative of a diesel fuel system which includes a lift pump 162 positioned outside of the fuel tank 158. Generally, the lift pump 162 draws diesel fuel from the reservoir 154 and pumps the fuel toward the engine, through one or more fuel rails (not shown), and through a fuel pressure regulator (not shown). Unused fuel is discharged from the fuel pressure regulator and returned to the reservoir 154 to power the jet pump assembly 150, which draws fuel from the fuel tank 158 to fill the reservoir 154. Alternatively, the jet pump assembly 150 may be employed in a gasoline fuel system (e.g., the fuel system shown in FIGS. 3, 4, 6, and 7) rather than a diesel fuel system.

With reference to FIG. 8, the jet pump assembly 150 includes a fuel supply conduit 166 and a jet pump 170 integrally formed as a single piece with the fuel supply conduit 166 and oriented substantially normal to the fuel supply conduit 166. The jet pump 170 is in fluid communication with the fuel supply conduit 166 to receive pressurized fuel from the fuel supply conduit 166 during operation of the lift pump 162. The pressurized fuel returning from the engine (i.e., the fuel downstream of the fuel pressure regulator) is at a lower pressure than the fuel consumed by the engine. As such, a throttle member (e.g., throttle members 54, 54*a* in FIGS. 3 and 6, respectively) upstream of the jet pump assembly 150 is not necessary. However, such a throttle member may be utilized to further reduce the pressure of the fuel delivered to the jet pump assembly 150.

With reference to FIG. 8, the jet pump assembly 150 also includes a base 174 integrally formed as a single piece with the fuel supply conduit 166 and the jet pump 170. The base 174 defines an internal chamber 178 having an opening 182 adjacent the bottom of the base 174 through which fuel is drawn in response to fuel being discharged through the jet pump 170. The reservoir 154 includes a receptacle (not shown) sized to receive the base 174 therein. An interference fit between the receptacle and the base 174 may be employed to at least partially secure the jet pump assembly 150 to the reservoir 154. Alternatively, any of a number of different fasteners or processes may be employed to secure the jet pump assembly 150 to the reservoir 154. (e.g., using screws, quick-connect structures, welding, adhesives, etc.).

With reference to FIG. 9, a one-way valve 186 (e.g., an umbrella-style valve) is coupled to the bottom of the reservoir 154 and is positioned within the chamber 178 of the base 174. Such a valve 186 is described in more detail in U.S. Pat. No. 5,769,061, the entire content of which is incorporated herein by reference. As is discussed in more detail below, the discharge of fuel through the jet pump 170 creates a region of low pressure within the chamber 178, thereby opening the one-way valve 186 to allow fuel in the fuel tank 158 to be drawn into the chamber 178 and subsequently mixed with the fuel discharged through the jet pump 170. The mixed fuel is then discharged into the reservoir 154 to fill the reservoir 154. However, shortly after deactivation of the lift pump 162, fuel stops flowing through the jet pump 170, allowing the pressure exerted on each side of the one-way valve 186 to equalize which, in turn, allows the valve 186 to close. When the valve 186 is closed, fuel in the reservoir 154 is prevented from back-flowing through the jet pump 170 and siphoning to the fuel tank 158.

With reference to FIG. 8, the jet pump 170 includes an orifice 190 positioned adjacent the chamber 178 and a mixing tube 194 positioned downstream of the orifice 190. Unlike the jet pump assemblies 10, 122 in FIGS. 1-7, the passageway in the jet pump 170 between the fuel supply conduit 166 and the orifice 190 does not include a converging section (i.e., a "converging nozzle") to increase the flow rate of fuel as it passes through the jet pump 170. Rather, the passageway in the jet pump 170 between the fuel supply conduit 166 and the orifice 190 is substantially straight. Alternatively, the passageway in the jet pump 170 between the fuel supply conduit 166 and the orifice 190 may include a converging nozzle section to increase the flow rate of fuel through the jet pump 170. As described above, discharge of fuel through the orifice 190 creates a region of low pressure within the chamber 178 to open the one-way valve 186, thereby allowing fuel from the fuel tank 158 to be drawn into the chamber 178, where the fuel is mixed with fuel discharged through the orifice 190. The mixed fuel is then discharged from the mixing tube 194 into the reservoir 154. The jet pump assembly 150 may optionally include a plug (e.g., a ball bearing 196) positioned within an aperture 197 formed in an outer wall of the jet pump 170 while molding the fuel supply conduit 166, the base 174, and the jet pump 170 as a single piece. Specifically, the aperture 197 may be formed by a slide used in an injection molding process to mold the passageway in the jet pump 170 between the fuel supply conduit 166 and the orifice 190, and the orifice 190 itself. As such, insertion of the ball bearing 196 into the aperture 197 (via an interference fit, for example) effectively blocks the aperture 197 to substantially prevent fuel flow through the aperture 197. Because the ball bearing 196 is a separate and distinct component from the fuel supply conduit 166, the base 174, and the jet pump 170, the jet pump 170 is manufactured as a multi-piece or two-piece jet pump 170. It should also be understood that the jet pump assemblies 10, 122 of FIGS. 1 and 5 may be manufactured in a similar manner to include one or more ball bearings for sealing or blocking apertures formed by slides used in an injection molding process to mold the nozzles 66, 78, 66*a*, 78*a*.

With continued reference to FIG. 8, the jet pump assembly 150 also includes an anti-siphon valve 198 incorporated in the fuel supply conduit 166. The anti-siphon valve 198 includes a plurality of ribs 202 extending radially inwardly into the fuel supply conduit 166. The ribs 202 are integrally formed as a single piece with the fuel supply conduit 166. Although only two ribs 202 are visible in FIG. 8, at least three ribs 202 extend radially inwardly into the fuel supply conduit 166. In addition, the ribs 202 are arranged symmetrically (i.e., equi-angularly spaced from each other) about a central axis of the fuel supply conduit 166. Alternatively, the ribs 202 may be arranged asymmetrically about the central axis of the fuel supply conduit 166, the purpose of which is discussed below. Each of the ribs 202 includes an inclined corner surface 206, the purpose of which is also discussed below. Alternatively, each of the ribs 202 may include a rounded corner or a ninety-degree corner toward the top of each rib 202.

With continued reference to FIG. 8, the anti-siphon valve 198 also includes an orifice 210 defined in the fuel supply conduit 166. More particularly, the orifice 210 is defined by an adapter 214 coupled to the fuel supply conduit 166. As shown in FIG. 8, the adapter 214 is a separate and distinct component from the fuel supply conduit 166 that is secured to the fuel supply conduit 166 during manufacture of the jet pump assembly 150 (e.g., by using an interference fit, welding, adhesives, etc.). Alternatively, the adapter 214 may be integrally formed as a single piece with the fuel supply conduit 166.

The anti-siphon valve 198 further includes a ball 218 movable in the fuel supply conduit 166 between a first position, in which the ball 218 is seated against the inclined corner surfaces 206 of the ribs 202, and a second position, in which the ball 218 is positioned adjacent the orifice 210 to block the flow of fuel through the orifice 210. The ball 218 is buoyant in fuel, such that the ball 218 is floated to the second position by stagnant fuel in the fuel supply conduit 166 (i.e., when the lift pump 162 is deactivated) to block fuel flow through the orifice 210. Alternatively, the ball 218 may not be buoyant in fuel, and a brief reverse flow of fuel through the fuel supply conduit 166 may displace the ball 218 from its position shown in FIG. 8 supported by the ribs 202 toward the adapter 214. After the ball 218 is seated against the adapter 214 to block the orifice 210, the pressure of the stagnant fuel in the fuel supply conduit 166 may provide a sufficient force to maintain the ball 218 against the adapter 214 to block the orifice 210. As a further alternative, the anti-siphon valve 198 may include a resilient member (e.g., a spring) to bias the ball 218 toward the insert adapter 214 to block the orifice 210.

With continued reference to FIG. 8, the adapter 214 includes a plurality of barbs 222 arranged about its outer peripheral surface that facilitate securing a rubber or plastic tube 226 (schematically illustrated in FIG. 9) to the adapter 214 which supplies the jet pump assembly 150 with return fuel from the engine. The adapter 214 further includes a mount 230 having a receptacle 234 configured and sized to receive a post (not shown) upstanding from a bottom wall of the reservoir 154. The mount 230 is fixed to the post (e.g., by welding, using adhesives, etc.), thereby securing the fuel supply conduit 166, the base 174, and the jet pump 170 between the adapter 214 and the bottom wall of the reservoir 154. Alternatively, the base 174 may be fixed to the reservoir 154 (e.g., by welding, using adhesives, etc.) to directly secure the jet pump assembly 150 to the reservoir 154.

In operation of the lift pump 162 and the jet pump assembly 150, the return fuel from the engine is used to power the jet pump assembly 150 to fill the reservoir 154 with fuel (see FIG. 9). As discussed above, the pressure of the return fuel is reduced by the fuel pressure regulator on the engine prior to entering the fuel supply conduit 166. The return fuel flow from the engine opens the anti-siphon valve 198 by displacing the ball 218 away from the orifice 210 and holding or maintaining the ball 218 against the inclined corner surfaces 206 of the ribs 202. Because the ribs 202 are spaced from each other about the central axis of the fuel supply conduit 166, fuel flow through the fuel supply conduit 166 may occur around the ball 218 and through the gaps between adjacent ribs 202. Such fuel flow around the ball 218 would also cause the ball 218 to be seated or held against the inclined corner surfaces 206 of the ribs 202 in the middle of the fuel supply conduit 166 (i.e., the center of the ball 218 would be aligned with the central axis of the fuel supply conduit 166). Alternatively, in a configuration of the jet pump assembly 150 in which the ribs 202 are asymmetrically positioned about the central axis of the fuel supply conduit 166 (i.e., when the spacing between adjacent ribs 202 is unequal), the fuel flow around the ball 218 may cause the ball 218 to wedge between adjacent ribs 202 at a location offset from the middle of the inlet conduit 166, such that the center of the ball 218 would be misaligned with the central axis of the fuel supply conduit 166. This asymmetrical arrangement of the ribs 202 may decrease the amount of flutter experienced by the ball 218 during operation of the jet pump assembly 150.

After the pressurized fuel passes the anti-siphon valve 198, the pressurized fuel in the fuel supply conduit 166 is discharged through the orifice 190 of the jet pump 170. A low-pressure region within the chamber 178 of the base 174 is created, thereby opening the one-way valve 186 to allow fuel from the fuel tank 158 to be drawn into the chamber 178 where it is mixed with the fuel discharged through the orifice 190. The mixed fuel is then discharged through the mixing tube 194 and into the reservoir 154 to fill the reservoir 154. Shortly after the lift pump 162 is deactivated, the fuel flow through the fuel supply conduit 166 is stopped, thereby allowing the ball 218 to float upwardly toward the adapter 214 to block the orifice 210 to prevent fuel stored in the reservoir 154 from siphoning out of the fuel tank 158 via the jet pump assembly 150. Should the ball 218 not be buoyant in fuel, a brief reverse flow of fuel through the fuel supply conduit 166 may displace the ball 218 from its position shown in FIG. 8 supported by the ribs 202 toward the adapter 214. After the ball 218 is seated against the adapter 214 to block the orifice 210, the pressure of the stagnant fuel in the fuel supply conduit 166 would provide a sufficient force to maintain the ball 218 against the adapter 214 to block the orifice 210 and prevent fuel stored in the reservoir 154 from siphoning out of the fuel tank 158 via the jet pump assembly 150.

Figure 10:
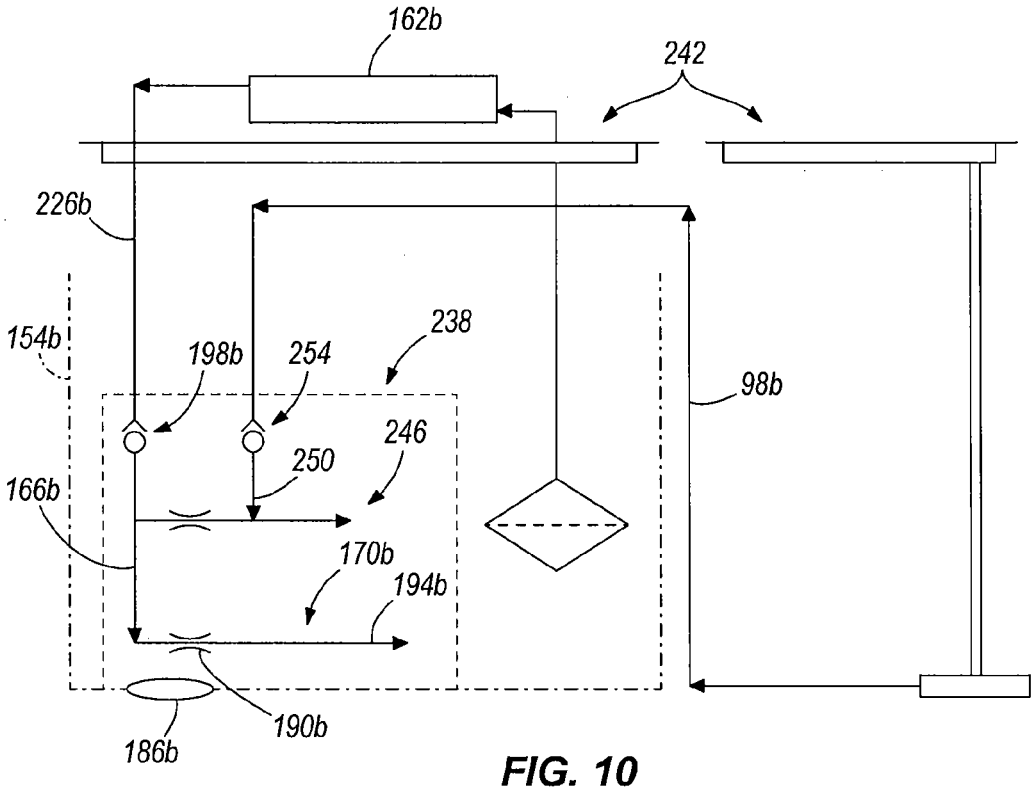
FIG. 10 is a schematic view of a fuel system arrangement including a fourth construction of a jet pump assembly of the present invention.

With reference to FIG. 10, a fourth construction of a jet pump assembly 238 is schematically illustrated. Like components are labeled with like reference numerals, with the letter "b." Like the fuel system arrangement shown in FIG. 9, the fuel system arrangement of FIG. 10 is illustrative of a diesel fuel system including a lift pump 162*b* positioned outside a fuel tank 242. However, the fuel tank 242 schematically illustrated in FIG. 10 is a bifurcated or saddle-style fuel tank 242 similar to the fuel tanks 38, 38*a* discussed above. As a result, the jet pump assembly 238 includes a secondary jet pump 246 integrally formed as a single piece with the fuel supply conduit 166*b*, an inlet conduit 250 integrally formed as a single piece with the secondary jet pump 246, and an anti-siphon valve 254 incorporated in the inlet conduit 250. The secondary jet pump 246, the inlet conduit 250, and the anti-siphon valve 254 are structurally similar to the secondary jet pump 74, 74*a*, the inlet conduit 86, 86*a*, and the anti-siphon valve 90, 90*a* of the jet pump assemblies 10, 122 of FIGS. 1-7, and will not be described again in detail. Likewise, the manner of operation of the secondary jet pump 246 and the anti-siphon valve 254 is similar to the manner of operation described above with respect to the secondary jet pump 74, 74*a* and anti-siphon valve 90, 90*a* of the jet pump assemblies 10, 122 of FIGS. 1-7, and will not be described again in detail.

Figure 11:
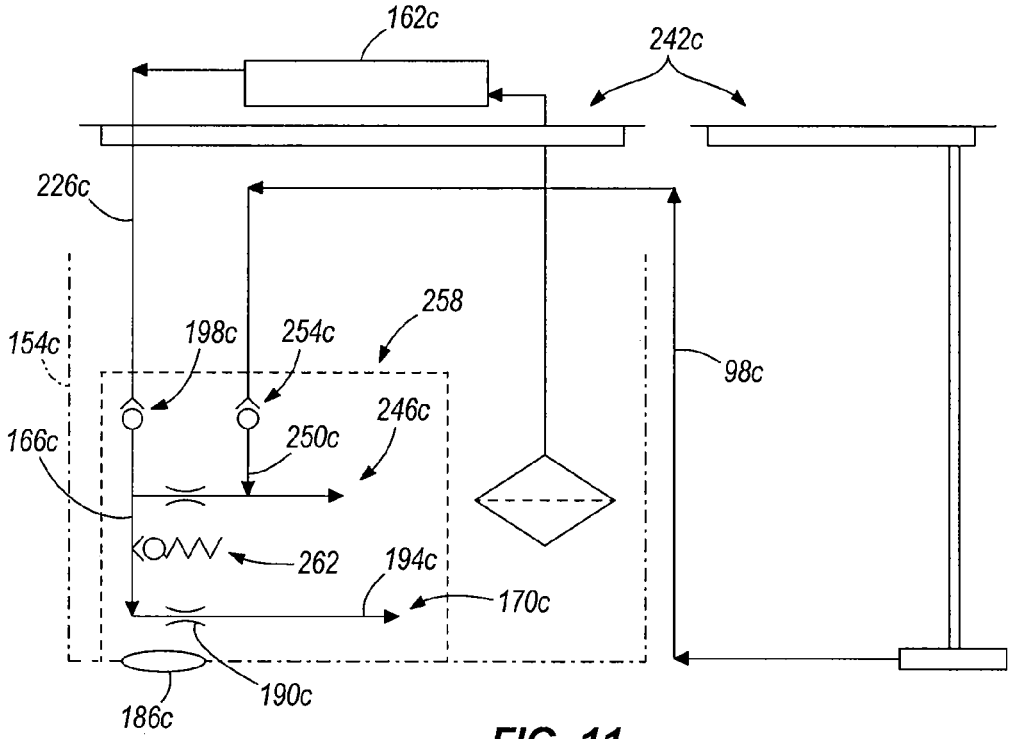
FIG. 11 is a schematic view of a fuel system arrangement including a fifth construction of a jet pump assembly of the present invention.

With reference to FIG. 11, a fifth construction of a jet pump assembly 258 is schematically illustrated. Like components are labeled with like reference numerals, with the letter "c." Like the fuel system arrangement shown in FIG. 10, the fuel system arrangement of FIG. 11 is illustrative of a diesel fuel system including a lift pump 162*c* positioned outside of a bifurcated or saddle-style fuel tank 242*c*, similar to the fuel tanks 38, 38*a*, 242 discussed above. However, the jet pump assembly 258 includes a pressure relief valve 262 in fluid communication with the fuel supply conduit 166*c* of the jet pump assembly 258. The pressure relief valve 262 is structurally similar to the pressure relief valve 126 of the jet pump assembly 122 of FIGS. 5-7, and will not be described again in detail. Likewise, the manner of operation of the pressure relief valve 262 is similar to the manner of operation of the pressure relief valve 126 of the jet pump assembly 122 of FIGS. 5-7, and will not be described again in detail. Furthermore, the manner of operation of the remaining components of the jet pump assembly 258 is similar to the manner of operation of those in the jet pump assembly 238, and will not be described again in detail.

Figure 12:
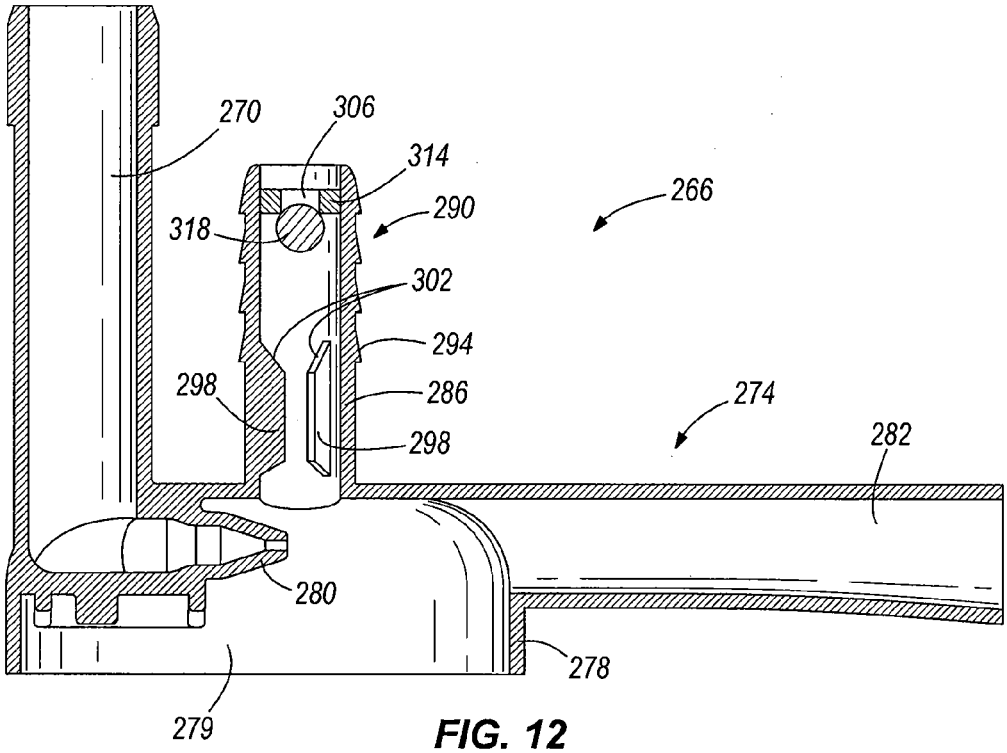
FIG. 12 is a cross-sectional view of a sixth construction of a jet pump assembly of the present invention.

FIG. 12 illustrates a sixth construction of a jet pump assembly 266 positionable in a reservoir of a fuel pump module for an internal combustion engine. The jet pump assembly 266 may be incorporated in either of the fuel system arrangements including the bifurcated or saddle-style fuel tanks 38 of FIGS. 3 and 4. More particularly, the jet pump assembly 266 may be powered by pressurized fuel output from a fuel pump of the fuel pump module or by return fuel from a fuel pressure regulator of the fuel pump module.

The jet pump assembly 266 includes a fuel supply conduit 270 and a jet pump 274 integrally formed as a single piece with the fuel supply conduit 270. The jet pump 274 is in fluid communication with the fuel supply conduit 270 to receive pressurized fuel from the fuel supply conduit 270 during operation of the fuel pump. With continued reference to FIG. 12, the jet pump assembly 266 also includes a base 278 integrally formed as a single piece with the fuel supply conduit 270 and the jet pump 234. The base 278 defines an internal chamber 279 having an opening adjacent the bottom of the base 278 through which fuel is drawn in response to fuel being discharged through the jet pump 274. The reservoir includes a receptacle (not shown) sized to receive the base 278 therein. An interference fit between the receptacle and the base 278 of the jet pump assembly 266 may be employed to at least partially secure the jet pump assembly 266 to the reservoir. Alternatively, any of a number of different fasteners or processes may be employed to secure the jet pump assembly 266 to the reservoir (e.g., using screws, quick-connect structures, welding, adhesives, etc.).

A one-way valve (e.g., an umbrella-style valve similar to those schematically illustrated in FIGS. 3, 4, 6, 7, and 9-11) is coupled to the bottom of the reservoir and is positioned within the internal chamber 279. The discharge of fuel through the jet pump 274 creates a region of low pressure within the internal chamber 279, thereby opening the one-way valve to allow fuel in the primary side of the fuel tank to be drawn into the internal chamber 279 and subsequently mixed with the fuel discharged through the jet pump 274. The mixed fuel is then discharged into the reservoir to fill the reservoir. However, shortly after deactivation of the fuel pump, fuel stops flowing through the jet pump 274, allowing the pressure exerted on each side of the one-way valve to equalize which, in turn, allows the valve to close. When the valve is closed, fuel in the reservoir is prevented from back-flowing through the jet pump 274 and siphoning to the primary side of the fuel tank.

The jet pump 274 also includes a nozzle 280 positioned adjacent the internal chamber 279 of the base 278 and a mixing tube 282 positioned downstream of the nozzle. As described above, discharge of fuel through the nozzle 280 creates a region of low pressure within the internal chamber 279 to open the one-way valve and draw fuel from the primary side of the fuel tank into the internal chamber 279, where the fuel is mixed with fuel discharged through the nozzle 280 in the mixing tube 282. The mixed fuel is then discharged from the mixing tube 282 into the reservoir.

With reference to FIG. 12, the jet pump assembly 266 further includes an inlet conduit 286 integrally formed as a single piece with the jet pump 274 and an anti-siphon valve 290 incorporated in the inlet conduit 286. The inlet conduit 286 fluidly communicates the jet pump 274 and the secondary side of the bifurcated or saddle-style fuel tank to allow the jet pump 274 to draw fuel from the secondary side of the fuel tank, in addition to the fuel drawn from the primary side of the fuel tank as discussed above. The inlet conduit 286 includes a plurality of barbs 294 arranged about its outer peripheral surface that facilitate securing a rubber or plastic "crossover" tube (similar to the crossover tube 98 in FIGS. 3 and 4) to the inlet conduit 286. The crossover tube extends from the inlet conduit 286, over the hump of the bifurcated or saddle-style fuel tank, and into the secondary side of the fuel tank.

With continued reference to FIG. 12, the anti-siphon valve 290 includes a plurality of ribs 298 extending radially inwardly into the inlet conduit 286. The ribs 298 are integrally formed as a single piece with the inlet conduit 286. Although only two ribs 298 are illustrated in FIG. 12, at least three ribs 298 extend radially inwardly into the inlet conduit 286. In addition, the ribs 298 are arranged symmetrically (i.e., equiangularly spaced from each other) about a central axis of the inlet conduit 286. Alternatively, the ribs 298 may be arranged asymmetrically about the central axis of the inlet conduit 286. Each of the ribs 298 includes an inclined surface 302 toward the top of each of the ribs 298. Alternatively, each of the ribs 298 may include a rounded corner or a ninety-degree corner toward the top of each of the ribs 298.

The anti-siphon valve 290 includes an orifice 306 defined in the inlet conduit 286. More particularly, the orifice 306 is defined within an annular insert 314 positioned in the inlet conduit 286. The insert 314 may be a separate and distinct component from the inlet conduit 286 that is secured to the inlet conduit 286 during manufacture of the jet pump assembly 266 (e.g., by using an interference fit, welding, adhesives, etc.). Alternatively, the insert 314 may be integrally formed as a single piece with the inlet conduit 286. The anti-siphon valve 290 also includes a ball 318 movable in the inlet conduit 286 between a first position, in which the ball 318 is seated against the top surfaces 302 of the ribs 298, and a second position, in which the ball 318 is positioned adjacent the orifice 306 to block the flow of fuel through the orifice 306. The ball 318 is buoyant in fuel, such that the ball 318 is floated to the second position to block fuel flow through the orifice 306 by stagnant fuel in the inlet conduit 286. Alternatively, the ball 318 may not be buoyant in fuel, and a brief reverse flow of fuel through the inlet conduit 286 in response to deactivation of the fuel pump may displace the ball 318 from being supported by the ribs 298 toward the insert 314. After the ball 318 is seated against the insert 314 to block the orifice 306, the pressure of the stagnant fuel in the inlet conduit may provide a sufficient force to maintain the ball 318 against the insert 314 to block the orifice 306. As a further alternative, the anti-siphon valve 290 may include a resilient member (e.g., a spring) to bias the ball 318 toward the insert 314 to block the orifice 306.

In operation of the fuel pump and the jet pump assembly 266, some of the pressurized fuel output by the fuel pump is diverted toward the jet pump assembly 266 to power the jet pump assembly 266 to fill the reservoir with fuel. Alternatively, return fuel from the pressure regulator may be used to power the jet pump assembly 266 to fill the reservoir with fuel. In either arrangement, pressurized fuel is supplied to the fuel supply conduit 270 which, in turn, feeds the jet pump 274. As the pressurized fuel is discharged through the nozzle 280 of the jet pump 274, a low-pressure region within the internal chamber 279 is created, thereby opening the one-way valve to allow fuel from the primary side of the fuel tank to be drawn into the internal chamber 279 of the base 278. Because the inlet conduit 286 is positioned adjacent the nozzle 280 of the jet pump 274 and exposed to the low-pressure region within the internal chamber 279, fuel is also drawn from the secondary side of the bifurcated or saddle-style fuel tank via the crossover tube, through the inlet conduit 286 and the opened anti-siphon valve 290, and into the internal chamber 279 of the base 278, where fuel from the primary and secondary sides of the fuel tank is mixed with the fuel discharged through the nozzle 280 in the mixing tube 282 and discharged into the reservoir to fill the reservoir.

The anti-siphon valve 290 is opened when the ball 318 is moved away from the insert 314 and held against the top surfaces 302 of the ribs 298 by the low-pressure region created in the inlet conduit 286 and the fuel flow through the inlet conduit 286. Because the ribs 298 are spaced from each other about the central axis of the inlet conduit 286, fuel flow through the inlet conduit 286 may occur around the ball 318 and through the gaps between adjacent ribs 298. Such fuel flow around the ball 318 would also cause the ball 318 to be seated or held against the top surfaces 302 of the ribs 298 in the middle of the inlet conduit 286 (i.e., the center of the ball 318 would be aligned with the central axis of the inlet conduit 286). Alternatively, in a configuration of the jet pump assembly 266 in which the ribs 298 are asymmetrically positioned about the central axis of the inlet conduit 286 (i.e., when the spacing between adjacent ribs 298 is unequal), the fuel flow around the ball 318 may cause the ball 318 to wedge between adjacent ribs 298 at a location offset from the middle of the inlet conduit 286, such that the center of the ball 318 would be misaligned with the central axis of the inlet conduit 286. This asymmetrical arrangement of the ribs 298 may decrease the amount of flutter experienced by the ball 318 during operation of the jet pump assembly 266.

Figure 13:
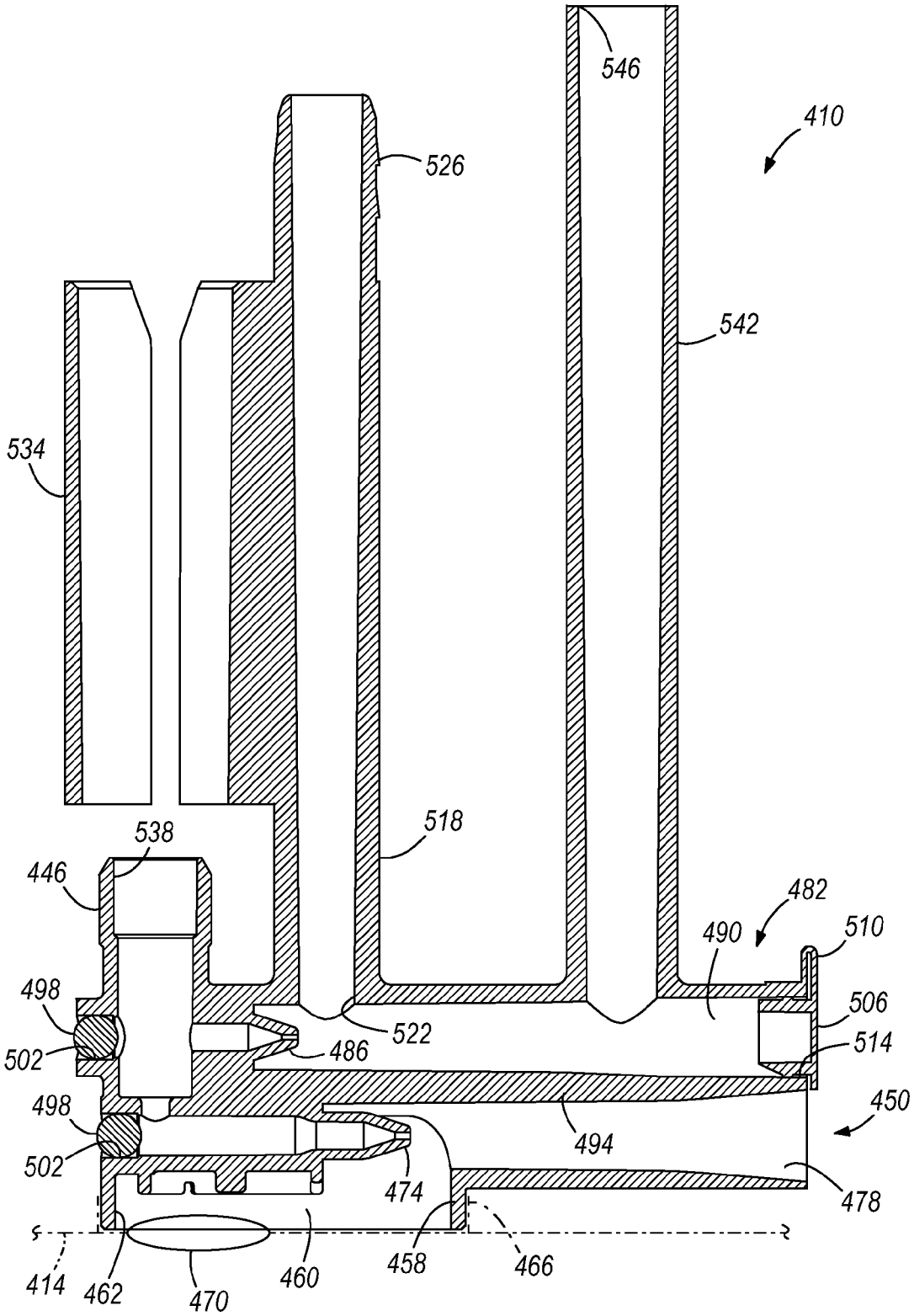
FIG. 13 is a cross-sectional view of a seventh construction of a jet pump assembly of the present invention.
Figure 14:
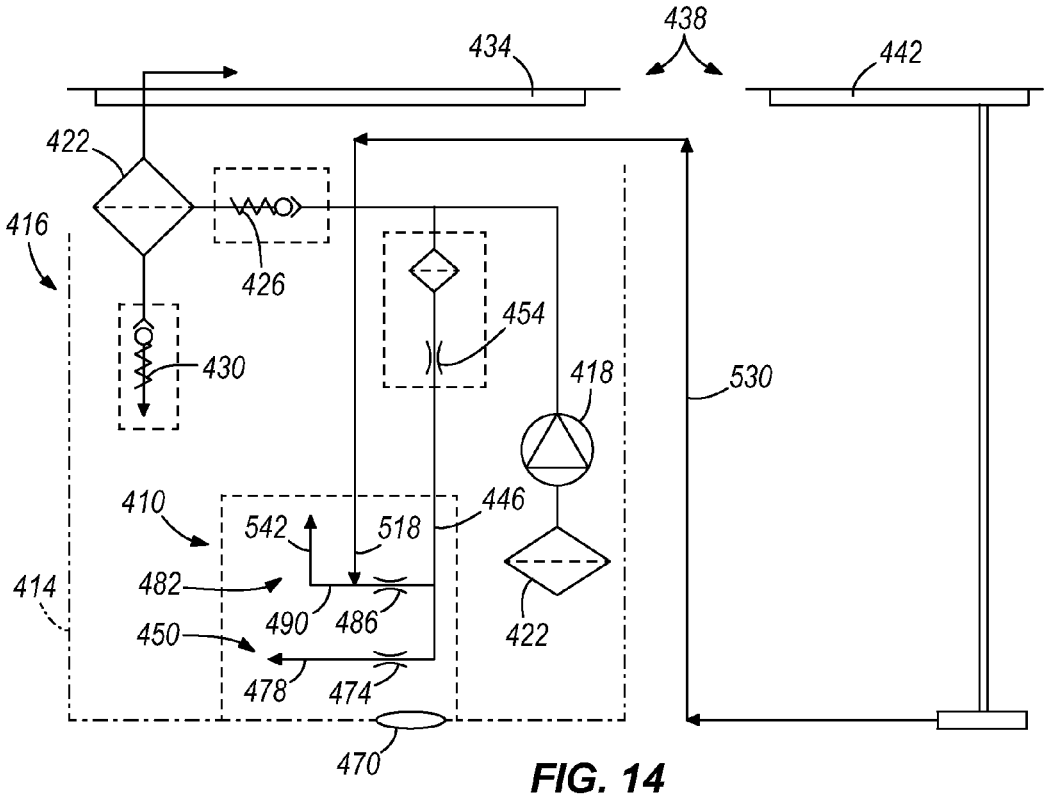
FIG. 14 is a schematic view of a first fuel system arrangement including the jet pump assembly of FIG. 13.
Figure 15:
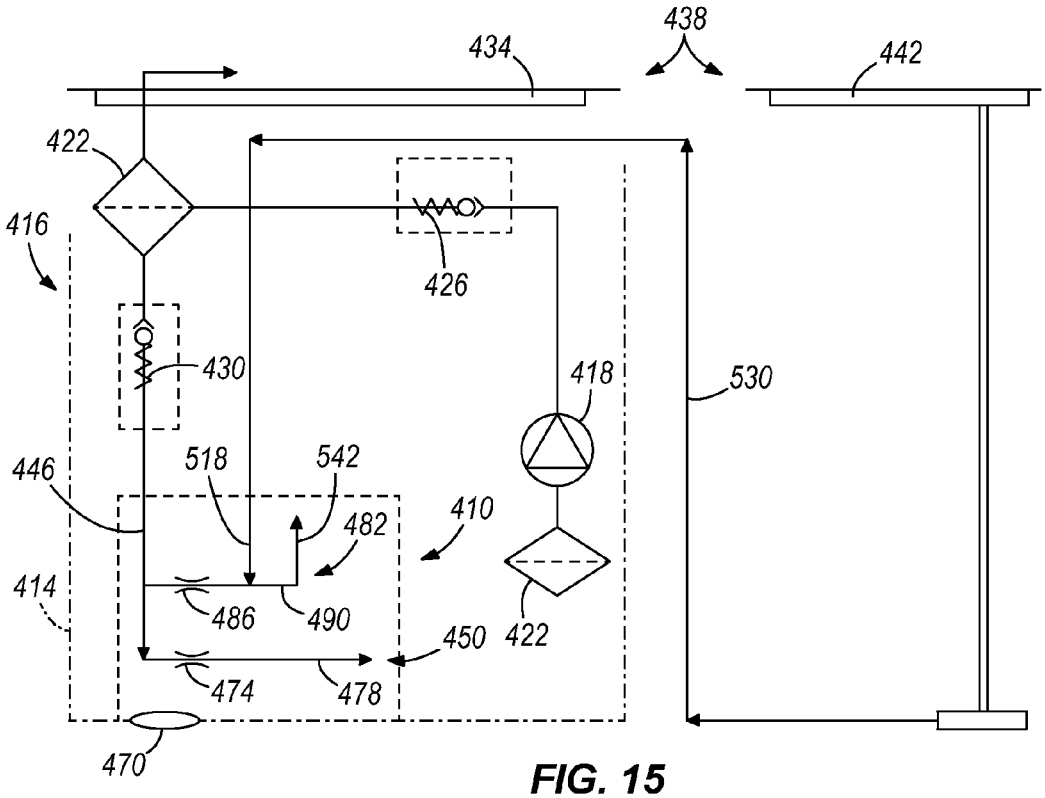
FIG. 15 is a schematic view of a second fuel system arrangement including the jet pump assembly of FIG. 13.

FIGS. 13-15 illustrate a seventh construction of a jet pump assembly 410 positionable in a reservoir 414 of a fuel pump module 416 for an internal combustion engine. In addition to the reservoir 414, other components of the fuel pump module 416 (e.g., a fuel pump 418, one or more filters 422, a check valve 426, and a fuel pressure regulator 430) are schematically illustrated in FIG. 14. The fuel pump module 416 is positioned on a primary side 434 of a bifurcated or saddle-style fuel tank 438. As described in more detail below, the jet pump assembly 410 draws fuel from both the primary side 434 of the fuel tank 438 and a secondary side 442 of the fuel tank 438 into the reservoir 414 to fill the reservoir 414 and substantially immerse the fuel pump 418 with fuel. This allows the fuel pump 418 to access a substantially continuous supply of fuel regardless of the level of fuel in the primary side 434 or the secondary side 442 of the fuel tank 438.

With reference to FIGS. 13 and 14, the jet pump assembly 410 includes a fuel supply conduit 446 and a first or primary jet pump 450 integrally formed as a single piece with the fuel supply conduit 446 and oriented substantially normal to the fuel supply conduit 446. The primary jet pump 450 is in fluid communication with the fuel supply conduit 446 to receive pressurized fuel from the fuel supply conduit 446 during operation of the fuel pump 418. With reference to FIG. 14, the fuel supply conduit 446 receives pressurized fuel directly from the output of the fuel pump 418 via a separate fuel supply conduit (not labeled). Specifically, the fuel pump module 416 also includes a throttle member 454 (e.g., an orifice) positioned upstream of the fuel supply conduit 446 to reduce the pressure of the pressurized fuel delivered to the fuel supply conduit 446. For example, the throttle member 454 may reduce the pressure of the pressurized fuel delivered to the fuel supply conduit 446 from about 5 bars to about 1 bar. Alternatively, the throttle member 454 may be configured to reduce the pressure of the pressurized fuel delivered to the fuel supply conduit 446 by a different amount.

With reference to FIG. 15, the jet pump assembly 410 may be positioned within the fuel pump module 416 such that the fuel supply conduit 446 receives "return" fuel from the fuel pressure regulator 430 to power the primary jet pump 450. The fuel pump 418 is sized to deliver fuel to the engine at a maximum flow rate and pressure. The fuel pressure regulator 430 provides a regulated supply of fuel to the engine that is often less than the maximum flow rate and pressure that the fuel pump 418 is capable of providing. The fuel pressure regulator 430, therefore, returns excess fuel that is not needed by the engine to the reservoir 414 to fill the reservoir 414. More particularly, the excess or return fuel from the fuel pressure regulator 430 is used to power the primary jet pump 450 before being returned to the reservoir 414.

With reference to FIG. 13, the jet pump assembly 410 also includes a base 458 integrally formed as a single piece with the fuel supply conduit 446 and the primary jet pump 450. The base 458 defines an internal chamber 460 having an opening 462 adjacent the bottom of the base 458 through which fuel is drawn in response to fuel being discharged through the primary jet pump 450. The reservoir 414 includes a receptacle 466 sized to receive the base 458 therein. An interference fit between the receptacle 466 and the base 458 of the jet pump assembly 410 may be employed to at least partially secure the jet pump assembly 410 to the reservoir 414. Alternatively, any of a number of different fasteners or processes may be employed to secure the jet pump assembly 410 to the reservoir 414 (e.g., using screws, quick-connect structures, welding, adhesives, etc.).

A one-way valve 470 (e.g., an umbrella-style valve) is coupled to the bottom of the reservoir 414 and is positioned within the internal chamber 460. As is discussed in more detail below, the discharge of fuel through the primary jet pump 450 creates a region of low pressure within the internal chamber 460, thereby opening the one-way valve 470 to allow fuel in the primary side 434 of the fuel tank 438 to be drawn into the internal chamber 460 and subsequently mixed with the fuel discharged through the primary jet pump 450. The mixed fuel is then discharged into the reservoir 414 to fill the reservoir 414. However, shortly after de-activation of the fuel pump 418, fuel stops flowing through the primary jet pump 450, allowing the pressure exerted on each side of the one-way valve 470 to equalize which, in turn, allows the valve 470 to close. When the valve 470 is closed, fuel in the reservoir 414 is prevented from back-flowing through the primary jet pump 450 and siphoning to the primary side 434 of the fuel tank 438.

With continued reference to FIG. 13, the primary jet pump 450 includes a nozzle 474 positioned adjacent the internal chamber 460 of the base 458 and a mixing tube 478 positioned downstream of the nozzle 474. As described above, discharge of fuel through the nozzle 474 creates a region of low pressure within the internal chamber 460 to open the one-way valve 470 and draw fuel from the primary side 434 of the fuel tank 438 into the chamber 460, where the fuel is mixed with fuel discharged through the nozzle 474 in the mixing tube 478. The mixed fuel is then discharged from the mixing tube 478 into the reservoir 414.

The jet pump assembly 410 also includes a second or secondary jet pump 482 integrally formed as a single piece with the fuel supply conduit 446 and the first or primary jet pump 450. The secondary jet pump 482 is in fluid communication with the fuel supply conduit 446 to receive pressurized fuel from the fuel supply conduit 446 during operation of the fuel pump 418. The primary and secondary jet pumps 450, 482 are fluidly connected to the fuel supply conduit 446 in a parallel arrangement, such that the pressure of the fuel delivered to each of the primary and secondary jet pumps 450, 482 is substantially similar (see also FIGS. 14 and 15). Alternatively, the throttle member 454 may be associated with only one of the primary and secondary jet pumps 450, 482 such that one of the jet pumps 450, 482 receives fuel at a higher pressure than the other. Further, an additional throttle member 454 may be associated with one of the primary and secondary jet pumps 450, 482 such that one of the jet pumps 450, 482 receives fuel at a lower pressure than the other.

With reference to FIG. 13, the secondary jet pump 482 includes a nozzle 486 and a mixing tube 490 positioned downstream of the nozzle 486. In the illustrated construction of the jet pump assembly 410, the mixing tubes 478, 490 of the first and second jet pumps 450, 482 are stacked one on top of the other (i.e., vertically aligned) such that the mixing tubes 478, 490 share a common wall 494. Alternatively, the mixing tubes 478, 490 may be situated side-by-side or horizontally aligned, or situated diagonally with respect to one another, while sharing a common wall. Each of the primary and secondary jet pumps 450, 482 includes a plug (e.g., a ball bearing 498) positioned within an aperture 502 formed in a respective outer wall of the jet pumps 450, 482 while molding the fuel supply conduit 446, the base 458, and the jet pumps 450, 482 as a single piece. Specifically, the apertures 502 may be formed by respective slides used in an injection molding process to mold the passageways of the nozzles 474, 486 in the respective jet pumps 450, 482. As such, insertion of the ball bearings 498 into the apertures 502 (via an interference fit, for example) effectively blocks the apertures 502 to substantially prevent fuel flow through the apertures 502.

The jet pump assembly 410 also includes a plug 506 integrally formed as a single piece with the secondary jet pump 482. In the illustrated construction of the jet pump assembly 410, the plug 506 and the mixing tube 490 are connected by an integral tether 510 to close an end 514 of the mixing tube 490 opposite the nozzle 486. As a result, fuel is prevented from being discharged from the end 514 of the mixing tube 490. Alternatively, the plug 506 may be configured as a ball bearing that is a separate and distinct component from the mixing tube 490.

With continued reference to FIG. 13, the jet pump assembly 410 further includes an inlet conduit 518 integrally formed as a single piece with the secondary jet pump 482. The inlet conduit 518 fluidly communicates the secondary jet pump 482 and the secondary side 442 of the bifurcated or saddle-style fuel tank 438 to allow the secondary jet pump 482 to draw fuel from the secondary side 442 of the fuel tank 438. The inlet conduit 518 includes an opening 522 positioned adjacent the nozzle 486 through which fuel is drawn into the mixing tube 490 as a result of a low-pressure region surrounding the nozzle 486 and in the inlet conduit 518 in response to fuel discharge through the nozzle 486. In the illustrated construction of the jet pump assembly 410, the inlet conduit 518 extends substantially perpendicularly from the mixing tube 490 and in a direction substantially parallel with the fuel supply conduit 446. Alternatively, the inlet conduit 518 may extend from the mixing tube 490 at an oblique angle. The inlet conduit 518 includes a plurality of barbs 526 arranged about its outer peripheral surface that facilitate securing a rubber or plastic "crossover" tube 530 to the inlet conduit 518. Such a crossover tube 530 (shown schematically in FIGS. 14 and 15) extends from the inlet conduit 518, over the hump of the bifurcated or saddle-style fuel tank 438, and into the secondary side 442 of the fuel tank 438.

With reference to FIG. 13, the jet pump assembly 410 includes a bracket 534 integrally formed as a single piece with the inlet conduit 518. The bracket 534 includes a substantially circular cross-sectional shape and facilitates alignment of an inlet end 538 of the fuel supply conduit 446 with another fuel supply conduit (not shown) fluidly connected to either the output of the fuel pump 418 or a bypass port of the fuel pressure regulator 430, as shown in FIGS. 14 and 15. Alternatively, the bracket may be omitted from the jet pump assembly 410.

With reference to FIG. 13, the jet pump assembly 410 also includes a stand pipe 542 integrally formed as a single piece with the secondary jet pump 482. In the illustrated construction of the jet pump assembly 410, the stand pipe 542 extends substantially perpendicularly from the mixing tube 490 and in a direction substantially parallel with the inlet conduit 518 and the fuel supply conduit 446. Alternatively, the stand pipe 542 may extend from the mixing tube 490 at an oblique angle. The stand pipe 542 includes distal open 546 end that remains exposed or uncovered when the jet pump assembly 410 is positioned in the reservoir 414. As is described in more detail below, the stand pipe 542 substantially prevents fuel in the reservoir 414, below the distal open end 546 of the stand pipe 542 and outside of the jet pump assembly 410, from siphoning out of the reservoir 414 and into the secondary side 442 of the bifurcated or saddle-style fuel tank 438.

In operation of the fuel pump 418 and the jet pump assembly 410, some of the pressurized fuel output by the fuel pump 418 is diverted toward the jet pump assembly 410 to power the jet pump assembly 410 and fill the reservoir 414 with fuel (see FIG. 14). As discussed above, the pressure of the diverted fuel is reduced by the throttle member 454 prior to entering the fuel supply conduit 446. The pressurized fuel in the fuel supply conduit 446 then feeds both the primary and secondary jet pumps 450, 482. As the pressurized fuel is discharged through the nozzle 474 of the primary jet pump 450, a low-pressure region within the internal chamber 460 of the base 458 is created, thereby opening the one-way valve 470 to allow fuel from the primary side 434 of the fuel tank 438 to be drawn into the internal chamber 460. Fuel drawn into the internal chamber 460 of the base 458 is mixed with the fuel discharged through the nozzle 474 in the mixing tube, 478 and is subsequently discharged into the reservoir 414 to fill the reservoir 414. While this occurs, pressurized fuel discharged through the nozzle 486 of the secondary jet pump 482 creates a low-pressure region surrounding the nozzle 486 and within the inlet conduit 518, thereby drawing fuel from the secondary side 442 of the fuel tank 438 into the inlet conduit 518 (via the crossover tube 530). Fuel drawn through the inlet conduit 518 is mixed with fuel discharged through the nozzle 486 in the mixing tube 490, and the mixed fuel is discharged upwardly through the stand pipe 542 and into the reservoir 414 to fill the reservoir 414 with fuel from the secondary side 442 of the fuel tank 438.

Upon deactivation of the fuel pump 418, the one-way valve 470 closes to substantially prevent fuel in the reservoir 414 from back-flowing through the primary jet pump 450 and siphoning to the primary side 434 of the fuel tank 438. Some fuel in the reservoir 414 may, however, back-flow through the stand pipe 542, the secondary jet pump 482, and the inlet conduit 518 and siphon to the secondary side 442 of the fuel tank 438. As the level of fuel in the reservoir 414 reaches the distal open end 546 of the stand pipe 542, the remaining fuel in the stand pipe 542, the secondary jet pump 482, and the inlet conduit 518 may continue to siphon into the secondary side 442 of the fuel tank 438. However, any fuel in the reservoir 414 below the distal open end 546 of the stand pipe 542 and outside of the jet pump assembly 410 is prevented from siphoning into the secondary side 442 of the fuel tank 438, thereby maintaining a sufficient supply of fuel in the reservoir 414 in anticipation of reactivation of the fuel pump 418.

With reference to FIG. 15, operation of the jet pump assembly 410 is substantially similar as that described above with respect to FIG. 14, except the jet pump assembly 410 is powered by return fuel from the fuel pressure regulator 430 rather than receiving fuel directly from the output of the fuel pump 418. The return fuel provided by the fuel pressure regulator 430 has a reduced pressure compared to that of the fuel supplied to the engine, such that a throttle member 454 (e.g., throttle member 454) is not required upstream of the fuel supply conduit 446.

Various features of the invention are set forth in the following claims.

What is claimed is:

1. A jet pump assembly positionable in a reservoir of a fuel pump module positioned in a fuel tank, the jet pump assembly comprising:

a fuel supply conduit;

a first jet pump integrally formed as a single piece with the fuel supply conduit and in fluid communication with the fuel supply conduit, the first jet pump including a nozzle;

a second jet pump integrally formed as a single piece with the fuel supply conduit and in fluid communication with the fuel supply conduit, the second jet pump including a nozzle and a mixing tube positioned downstream of the nozzle of the second jet pump;

an inlet conduit integrally formed as a single piece with the second jet pump and extending from the mixing tube;

a base positioned below the nozzle of the first jet pump, the base defining an internal chamber having an opening through which fuel is drawn as a result of a low-pressure region created in the internal chamber by discharge of fuel through the nozzle of the first jet pump; and a stand pipe extending from the mixing tube.

2. The jet pump assembly of claim 1, wherein the stand pipe is integrally formed as a single piece with the mixing tube of the second jet pump.

3. The jet pump assembly of claim 2, wherein the inlet conduit and the stand pipe are substantially parallel.

4. The jet pump assembly of claim 1, wherein the first jet pump is operable to draw fuel from a first portion of the fuel tank into the reservoir, and wherein the second jet pump is operable to draw fuel from a second portion of the fuel tank remote from the first portion through the inlet conduit, through the stand pipe, and into the reservoir.

5. The jet pump assembly of claim 4, wherein the stand pipe includes an open distal end, and wherein the stand pipe substantially prevents fuel in the reservoir, below the open distal end of the stand pipe and outside of the jet pump assembly, from siphoning out of the reservoir and into the second portion of the fuel tank.

6. The jet pump assembly of claim 1, wherein the mixing tube includes an end opposite the nozzle of the second jet pump, and wherein the end is closed such that fuel discharged into the mixing tube is subsequently discharged from the jet pump assembly through the stand pipe.

7. The jet pump assembly of claim 1, wherein the first jet pump includes a mixing tube positioned downstream of the nozzle of the first jet pump.

8. The jet pump assembly of claim 7, wherein the nozzle of the first jet pump is positioned adjacent the internal chamber.

9. The jet pump assembly of claim 1, wherein the first and second jet pumps are integrally formed as a single piece.

10. The jet pump assembly of claim 1, wherein the fuel supply conduit is a first fuel supply conduit and the fuel pump module includes a second fuel supply conduit configured to interconnect with the first fuel supply conduit, and wherein the jet pump assembly further includes a bracket configured to align the first and second fuel supply conduits with each other.

11. The jet pump assembly of claim 10, wherein the bracket is integrally formed as a single piece with the inlet conduit.

12. The jet pump assembly of claim 10, wherein the first fuel supply conduit includes an inlet end, and wherein the bracket is positioned above the inlet end of the first fuel supply conduit.

13. The jet pump assembly of claim 1, wherein the first jet pump includes a mixing tube, and wherein the mixing tubes of the first and second jet pumps, respectively, share a common wall.

14. The jet pump assembly of claim 1, further comprising an anti-siphon valve incorporated in the inlet conduit.

15. A fuel pump module comprising:

a fuel reservoir; and a separate jet pump assembly positioned in the fuel reservoir, the jet pump assembly including a fuel supply conduit, a first jet pump integrally formed as a single piece with the fuel supply conduit and in fluid communication with the fuel supply conduit, the first jet pump including a nozzle, a second jet pump integrally formed as a single piece with the fuel supply conduit and in fluid communication with the fuel supply conduit, the second jet pump including a nozzle and a mixing tube positioned downstream of the nozzle of the second jet pump, an inlet conduit integrally formed as a single piece with the second jet pump and extending from the mixing tube, a base positioned below the nozzle of the first jet pump, the base defining an internal chamber having an opening through which fuel is drawn as a result of a low-pressure region created in the internal chamber by discharge of fuel through the nozzle of the first jet pump, and a stand pipe extending from the mixing tube.

16. The fuel pump module of claim 15, wherein the stand pipe is integrally formed as a single piece with the mixing tube of the second jet pump.

17. The fuel pump module of claim 15, wherein the fuel pump module is positioned in a fuel tank, wherein the first jet pump is operable to draw fuel from a first portion of the fuel tank into the reservoir, and wherein the second jet pump is operable to draw fuel from a second portion of the fuel tank remote from the first portion through the inlet conduit, through the stand pipe, and into the reservoir.

18. The fuel pump module of claim 17, wherein the stand pipe includes an open distal end, and wherein the stand pipe substantially prevents fuel, below the open distal end of the stand pipe and outside of the jet pump assembly, from siphoning out of the reservoir and into the second portion of the fuel tank.

19. The fuel pump module of claim 15, wherein the reservoir includes a receptacle, and wherein the base is received within the receptacle.

20. The fuel pump module of claim 19, further comprising a one-way valve disposed in the receptacle.

21. The fuel pump module of claim 20, wherein the first jet pump includes a mixing tube positioned downstream of the nozzle of the first jet pump, wherein the nozzle of the first jet pump is positioned adjacent the internal chamber in the base, and wherein the one-way valve is moved to an open position in response to discharge of fuel through the nozzle of the first jet pump.

22. The fuel pump module of claim 15, further comprising an anti-siphon valve incorporated in the inlet conduit.

* * * * *